US005435428A

United States Patent [19]

Adachi et al.

[11] Patent Number: 5,435,428

[45] Date of Patent: Jul. 25, 1995

[54] ESCALATOR APPARATUS

[75] Inventors: Kazuo Adachi; Masato Yamashita; Yasusuke Tominaga, all of Osaka; Minako Horie, Nara, all of Japan

[73] Assignee: Fujitec Co., Ltd., Osaka, Japan

[21] Appl. No.: 179,643

[22] Filed: Jan. 10, 1994

[30] Foreign Application Priority Data

Jan. 13, 1993 [JP] Japan ..... 5-021912
Apr. 19, 1993 [JP] Japan ..... 5-116547
Jun. 25, 1993 [JP] Japan ..... 5-179912

[51] Int. Cl.[6] ..... B66B 29/08
[52] U.S. Cl. ..... 198/324; 198/333
[58] Field of Search ..... 198/333, 324, 321, 332

[56] References Cited

U.S. PATENT DOCUMENTS 4,557,369 12/1985 Ishida et al. ..... 198/333
4,681,207 7/1987 Goto et al. ..... 198/333
5,062,519 11/1991 Haruta ..... 198/333
5,295,569 3/1994 Kubota ..... 198/333
5,330,042 7/1994 Ogimura et al. ..... 198/333
5,332,077 7/1994 Ogimura ..... 198/324 X

FOREIGN PATENT DOCUMENTS

0513378A1 11/1992 European Pat. Off. .
56-41555 9/1981 Japan .
58-2153 1/1983 Japan .
64-1396 1/1989 Japan .

*Primary Examiner*—D. Glenn Dayoan
*Attorney, Agent, or Firm*—Jordan and Hamburg

[57] ABSTRACT

An escalator apparatus is provided which may be converted as desired to accommodate wheelchairs and other vehicles. Two specially adapted steps are disposed front and back of a standard step. Guide rails defining travel paths for the steps are located on a fixed portion of the escalator apparatus, and are adapted to engage cooperating elements carried on the steps. By directing the cooperating elements along different guide paths as desired, the special steps may be raised and lowered to be flush with the standard step between them, thereby forming a single vehicle step, without the need for stopping the motion of the escalator.

24 Claims, 30 Drawing Sheets

ESCALATOR APPARATUS

BACKGROUND OF THE INVENTION

The present invention relates to an escalator apparatus which can be safely utilized not only by ordinary passengers but also by special passengers who use vehicles such as wheelchairs, baby carriages and shopping carts.

BACKGROUND ART

Conventional escalators have been designed to transport ordinary passengers and hence the depth dimension of the steps is about 400 mm. Therefore, it has been difficult to transport wheelchairs or baby carriages safely while maintaining their horizontal state.

Therefore, various suggestions have been made including;

(1) a first arrangement in which, as in the case of Japanese Patent Publication No. 41555/1981, one or more large-sized steps having a sufficient depth dimension to transport a wheelchair or the like are incorporated in advance and man conveyor start and stop switches for exclusive use by physically handicapped persons are installed, the arrangement being such that operating such stop switch causes the large-sized step to stop at the entrance area without fail and pushing the exclusive start switch subsequent to wheelchair passengers stepping on causes the escalator to start, the large-sized step being stopped again at the exit area in the desired story after the lapse of a given time, (2) a second arrangement in which, as in the case of Japanese Patent Publication No. 2153/1983, all steps are connected by pivotally connecting the main and auxiliary treads to construct an escalator having a substantially greater depth dimension capable of carrying vehicles, and (3) a third arrangement in which, as in the case of Japanese Patent Publication No. 1396/1989, a lifting mechanism is separately installed for lifting the tread of a step to the position of the tread of the upper step adjacent thereto so as to substantially increase the area of the tread.

In the escalator apparatus like (1) above, however, the presence of the large-sized steps, though small in number, each having a sufficient depth dimension to carry a wheelchair or the like thereon, makes it necessary to increase the radii of the sprocket wheels for return drive at the entrance and exit areas, necessarily increasing the size of the escalator and limiting the installation space.

In an escalator apparatus like (2) above, if large-sized steps each having a sufficient depth dimension to carry a large-sized wheelchair are prepared and the step height is set at about 200 mm which is the same as in a conventional escalator, then the maximum inclination angle of the escalator obtainable is only about 10°, so that in order to obtain the required lift, the overall length of the escalator has to be increased. In an escalator apparatus like (3) above, a sufficient space to receive a large-sized wheelchair cannot be obtained and a passenger has to step on the escalator with his face directed opposite to the direction of travel of the escalator when the latter is ascending; thus, he will be endangered unless the escalator is stopped without fail at the time of stepping on and off, and the traffic will be halted each time a wheelchair passenger utilizes the escalator.

The present invention has been made with the above in mind and is intended to provide an escalator apparatus which allows a passenger, even if using a vehicle, to utilize it without necessarily stopping the escalator and which requires only a minimum installation space.

SUMMARY OF THE INVENTION

Escalators according to the present invention are characterized in that:

At least two special steps included in a plurality of steps are disposed with a third step interposed therebetween, the first special step having a downwardly movable tread, the second special step having an upwardly movable tread, said movable treads being adapted to ascend or descend according to the height of the tread of the third step. The movable treads may be adapted to ascend or descend in such a manner that they come to a position in alignment with the height of the tread of the third step. The second special step may have an interlocking mechanism for allowing an upwardly movable tread to ascend or descend according to the height of the tread of the third step.

Escalators according to the present invention are characterized also in that;

At least two special steps included in a plurality of steps are disposed with a third step interposed therebetween, the first special step comprising a first fixed step and a first movable step movable downwardly relative to said first fixed step, the second special step comprising a second fixed step and a second movable step movable upwardly relative to said second fixed step, each of said first and second movable steps being provided with a wheel guided by a guide rail.

In all of the above arrangements, said second special step may further have an amplifying mechanism for amplifying the upward movement of said tread or said second movable step of said second special step.

With the above arrangements employed, the remodeling and restoration of steps can be made as desired.

The present invention includes various other arrangements as recited in the claims and/or disclosed in the description and the drawings of this application.

According to the present invention described above, even when the steps of an escalator are moving, the remodeling and restoration of steps can be made reliably and smoothly, so that it is not absolutely necessary to stop the escalator for a passenger who uses a wheelchair or the like vehicle (it goes without saying that there is another way of use in which the escalator is stopped during stepping on but it is not stopped during stepping off); thus, both healthy persons and vehicle users can simultaneously utilize the escalator reasonably and safely.

DESCRIPTION OF THE PREFERRED EMBODIMENTS

Figure 1:
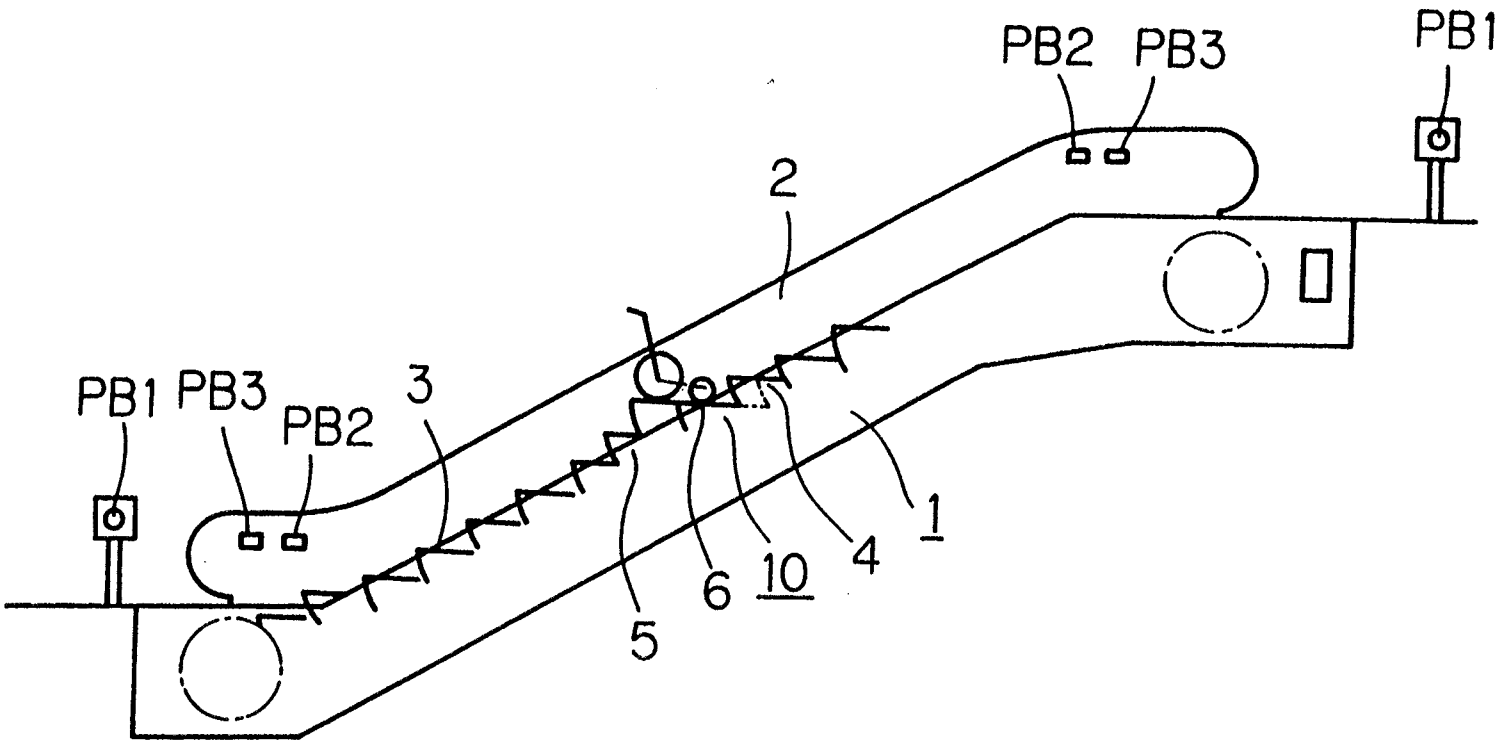
FIG. 1 is a schematic view showing the arrangement of an escalator in its entirely according to the present invention.
Figure 2:
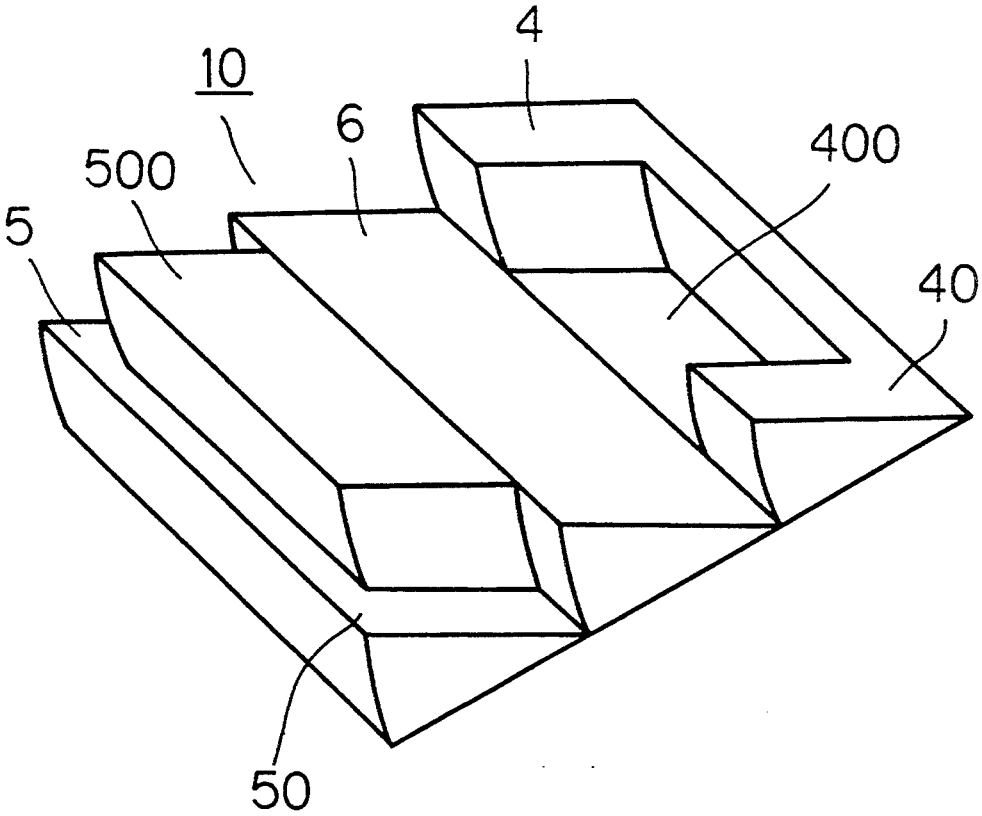
FIG. 2 is an enlarged perspective view of a vehicle step 10 according to the invention.

FIG. 1 is a schematic view showing the arrangement of an escalator in its entirety according to the present invention, and FIG. 2 is an enlarged perspective view of a vehicle step 10 in FIG. 1. In the figures, the numeral 1 denotes an escalator body; 2 denotes a balustrade; 3 denotes ordinary steps; 4 denotes a special step with its tread adapted to move downward, as desired; the numeral 5 denotes a special step with its tread adapted to move upward. A step 6 not much different from the ordinary steps 3 is interposed between the special steps 4 and 5. The special steps 4 and 5 and the step 6 constitute a vehicle step 10.

The character PB1 denotes a vehicle operating button. When a passenger using a wheelchair or the like wants to use the escalator, he pushes this button PB1, whereby the vehicle step 10, when approaching the entrance area, is decelerated to make it easier for the person using the vehicle to step on. The character PB2 denotes stepping-on confirmation buttons which, when pushed, gradually accelerates the escalator until the latter reaches the rated speed. The character PB3 denotes stepping-off confirmation buttons which, when pushed, restore the escalator to its ordinary state. In addition, such system using push buttons may be replaced by a different system using transmitters.

Figure 3:
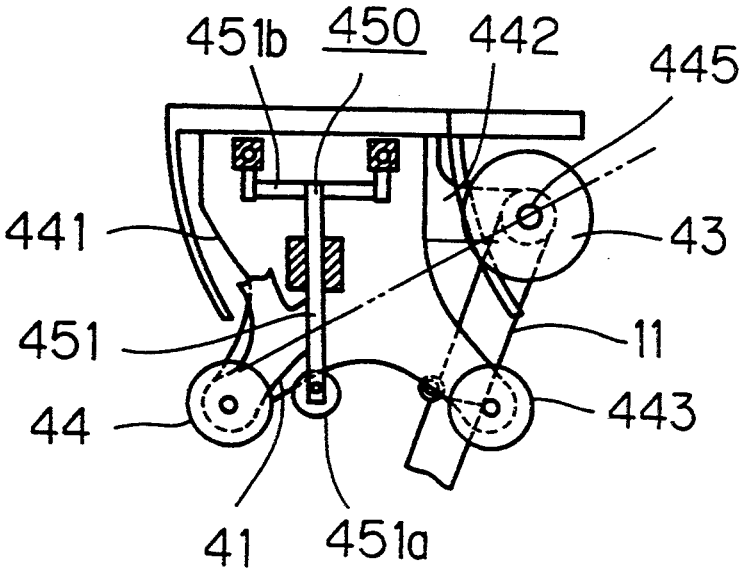
FIG. 3 is an enlarged side view of a special step 4 shown in FIG. 2.
Figure 4:
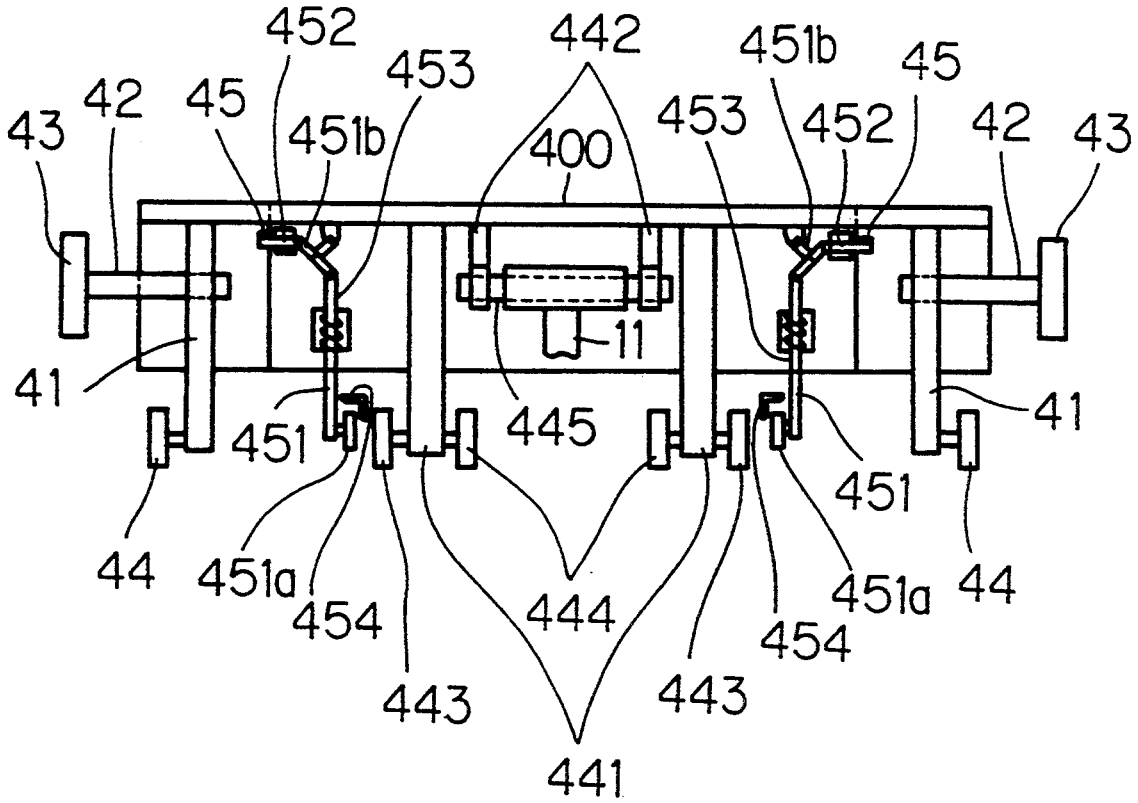
FIG. 4 is an enlarged front view of the special step 4 shown in FIG. 2.
Figure 5:
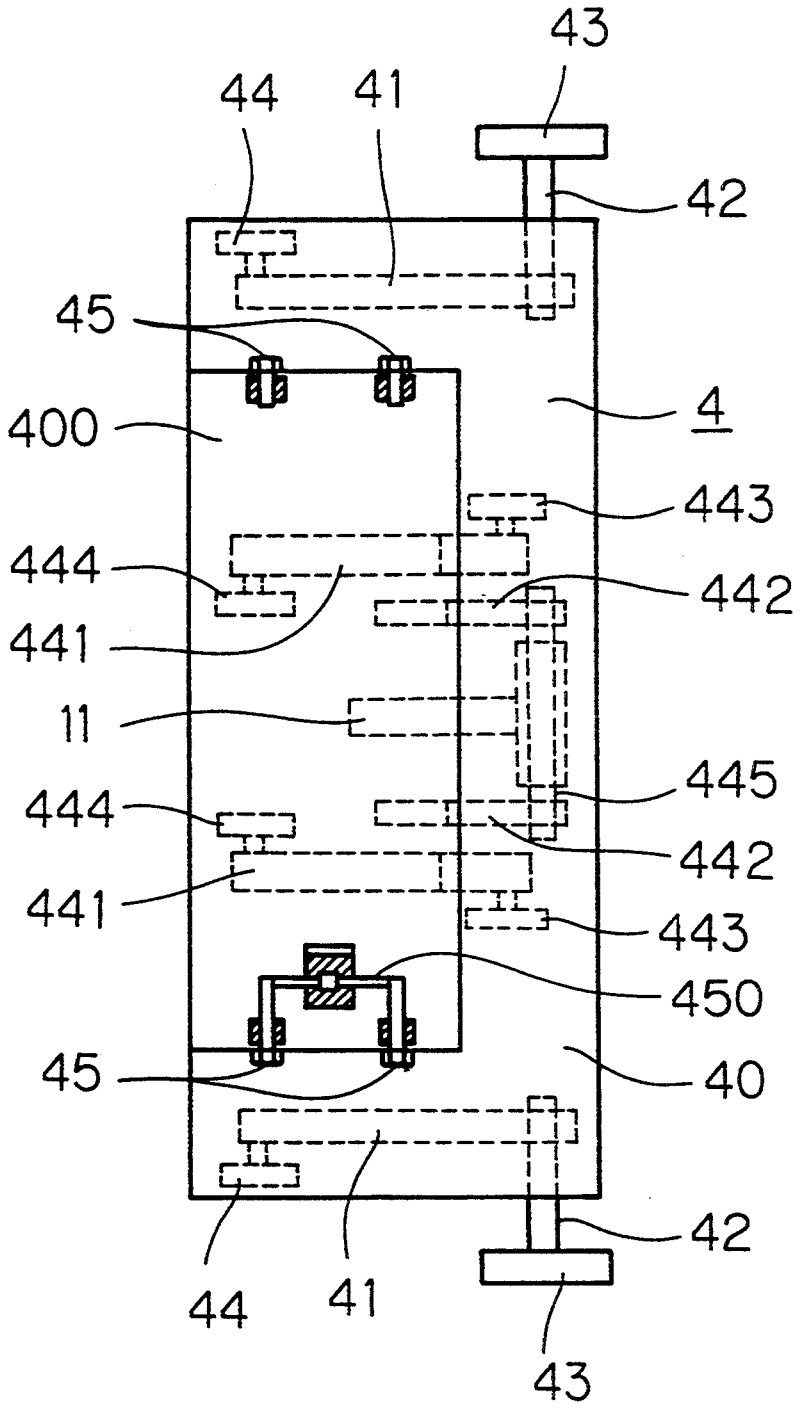
FIG. 5 is an enlarged plan view of the special step 4 shown in FIG. 2.

FIG. 3 is an enlarged side view of the special step 4 in FIG. 2, FIG. 4 is a front view thereof, and FIG. 5 is a plan view thereof. The special step 4 comprises, for example, a fixed step 40 and a movable step 400, said fixed step 40 being provided with yokes 41 having front and rear wheels 43 and 44 rotatably attached thereto through axle shafts 42 and other shafts respectively and provided on its inner surface directed to said movable step 400 with concave latch supports 45 at four places.

On the other hand, the movable step 400 is provided with yokes 441 and brackets 442, said yokes 441 having front and rear wheels 443 and 444 rotatably attached thereto, said brackets 442 having a shaft 445 fixed thereto. Further, the movable step 400 is provided with locking devices 450 on opposite sides to be later described. Each locking device 450 is provided with a rod 451 having a roller 451*a* rotatably attached to the lower end thereof and a link 451*b* attached to the upper end thereof, the other end of said link 451*b* being provided with a latch 452 adapted to engage and disengage said latch supports 45, said latch 452 being permanently urged by the force of a spring 453 in a direction to project. And the numeral 454 denotes unlocking tracks adapted to be downwardly moved by driving devices (not shown) and to guide rollers 451*a* thereunder.

Figure 6:
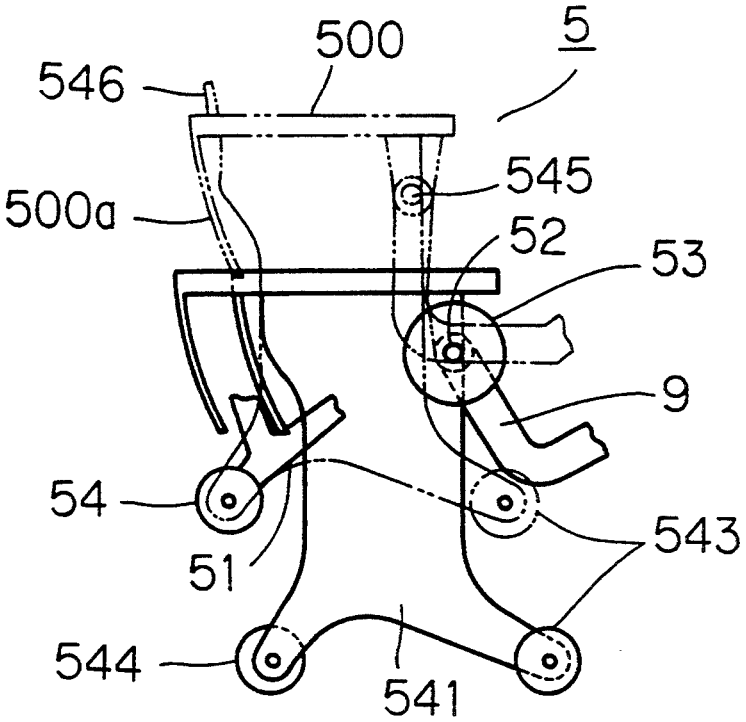
FIG. 6 is an enlarged side view of a special step 5 shown in FIG. 2.
Figure 7:
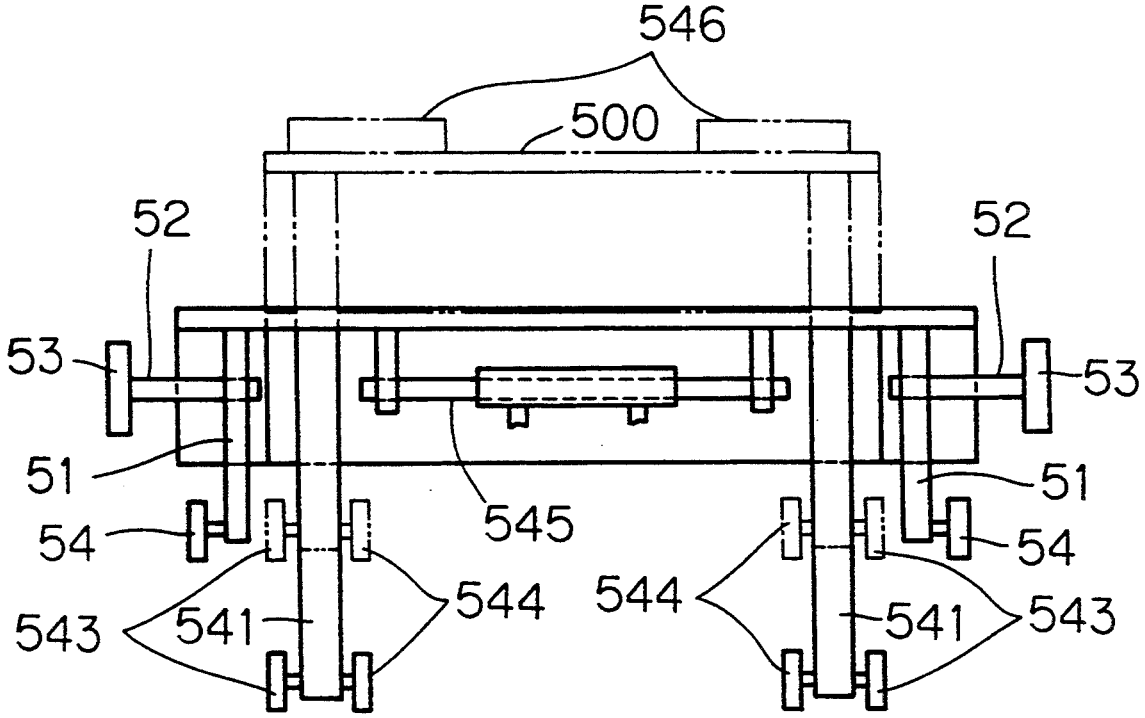
FIG. 7 is an enlarged front view of the special step 5 shown in FIG. 2.
Figure 8:
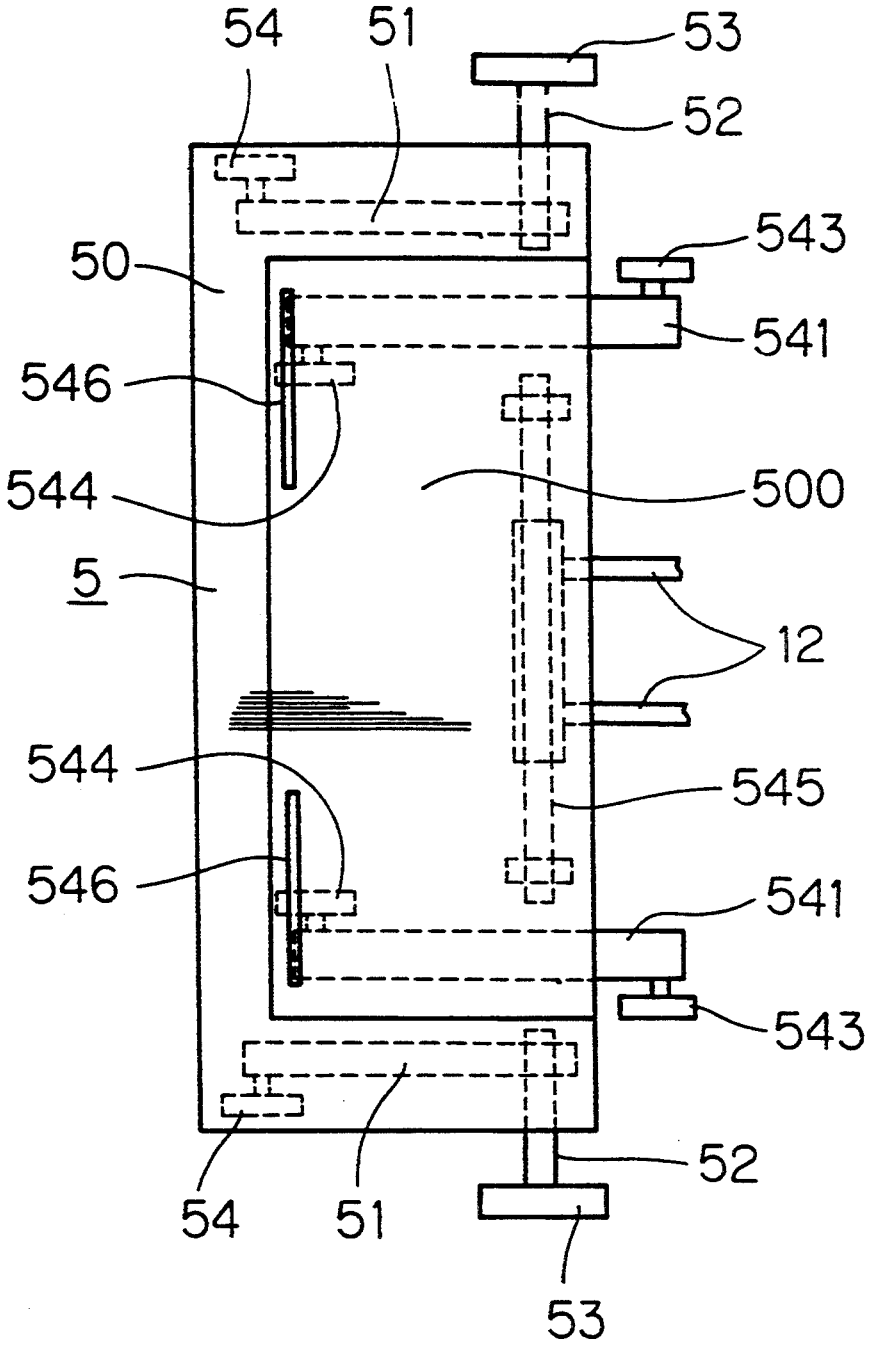
FIG. 8 is an enlarged plan view of the special' step 5 shown in FIG. 2.

FIG. 6 is an enlarged side view of the special step 5 in FIGS. 1 and 2, FIG. 7 is a front view thereof, and FIG. 8 is a plan view thereof. The special step 5 comprises, for example, a fixed step 50 and a movable step 500. The fixed step 50, like the fixed step 40, is provided with yokes 51, the latter having front and rear wheels 53 and 54 rotatably attached thereto through axle shafts 52 and other shafts respectively.

On the other hand, the movable step 500 is provided with yokes 541, the latter having front and rear wheels 543 and 544 rotatably attached thereto. The movable step 500 has a shaft 545 fixed to the middle thereof and wheel stops 546 disposed in a region close to the rear end and adapted to project, as desired. And the character 500*a* denotes a riser for the movable step 500. In addition, it is preferable to provide the same device as the locking device for the movable step 400 provided in the special step 4 described above, but such device is omitted from the illustration.

Figure 9:
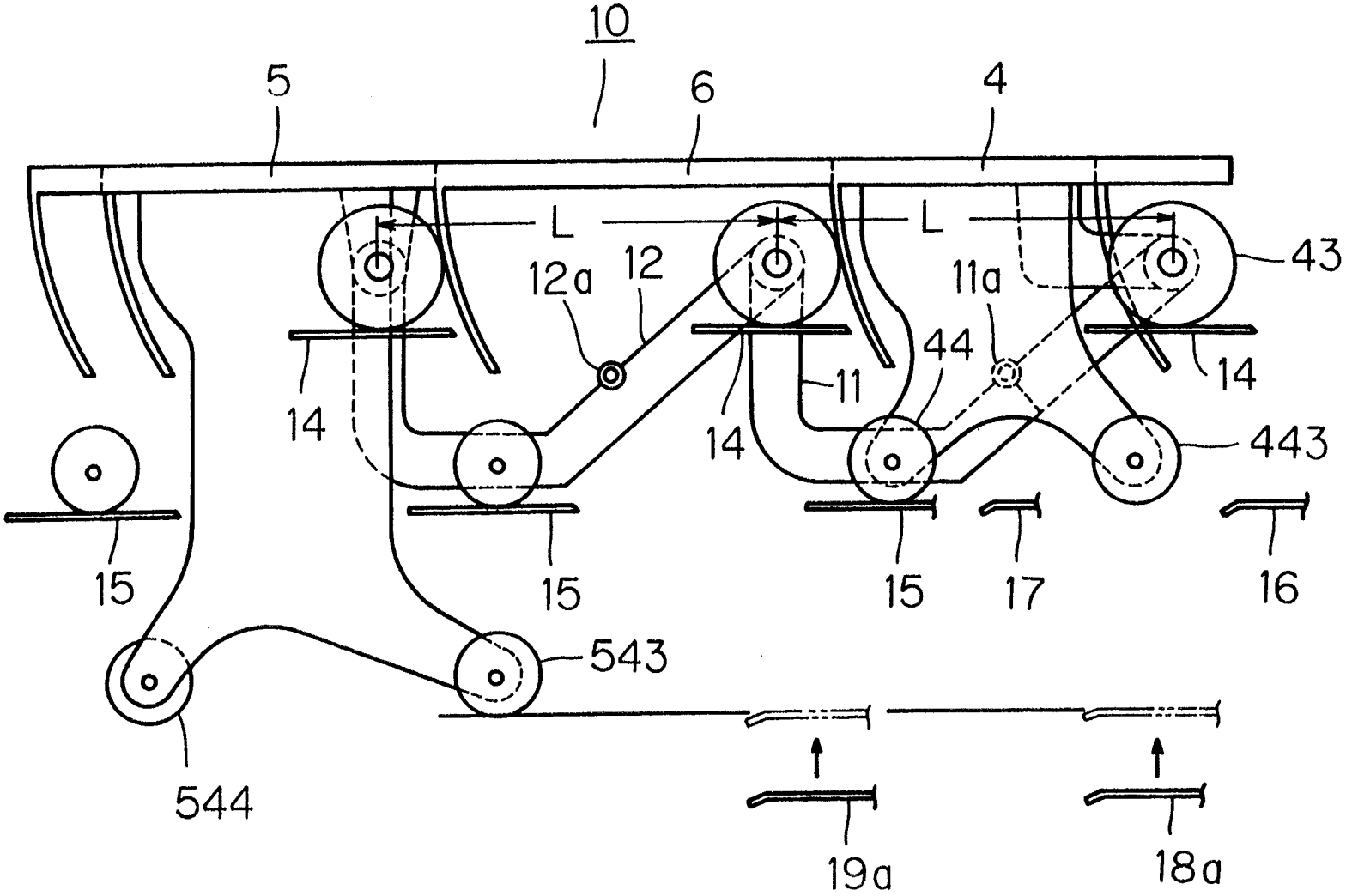
FIG. 9 is a side view showing the connected state of the vehicle step 10 shown in FIG. 2.
Figure 10:
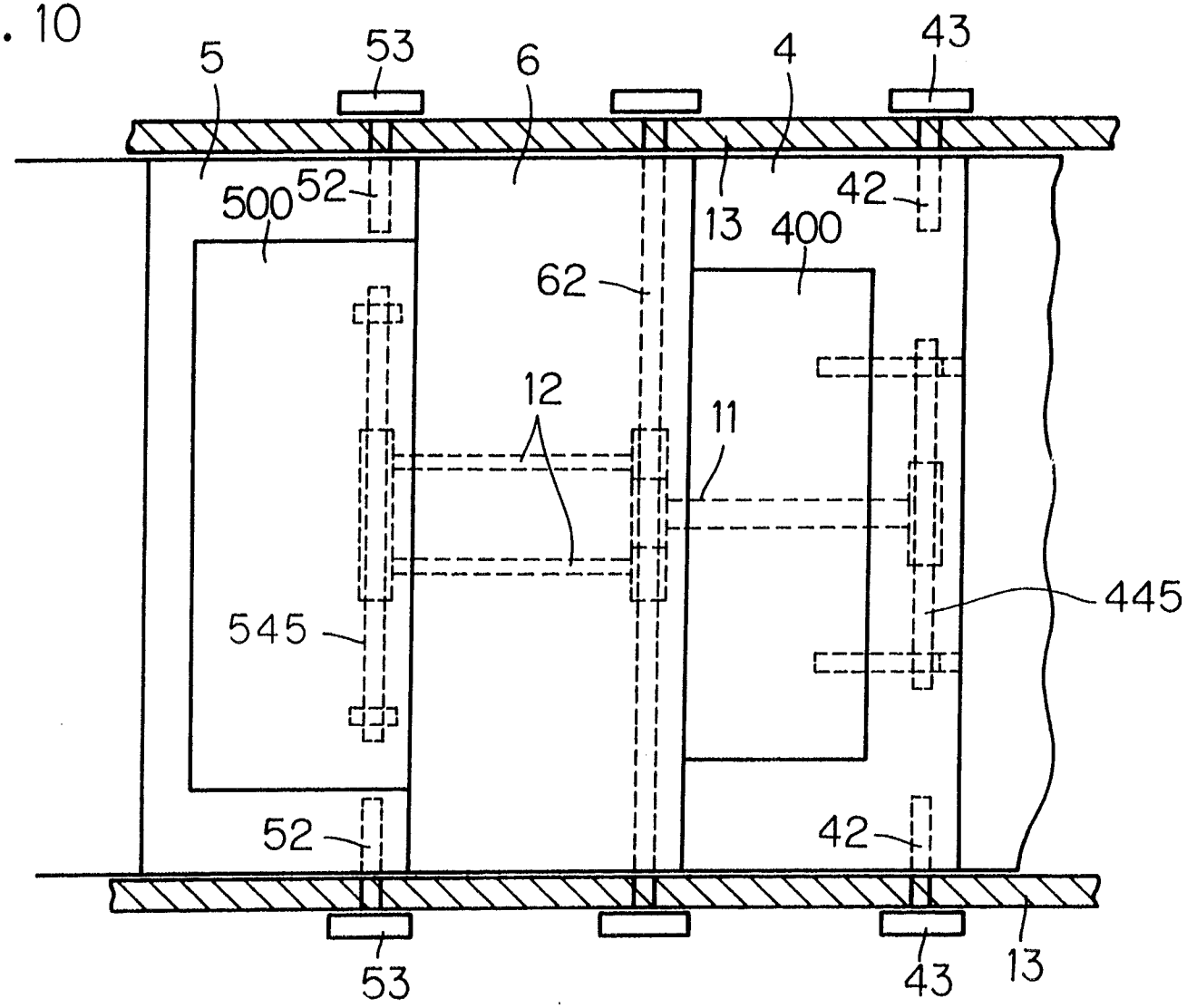
FIG. 10 is a plan view of FIG. 9.
Figure 11:
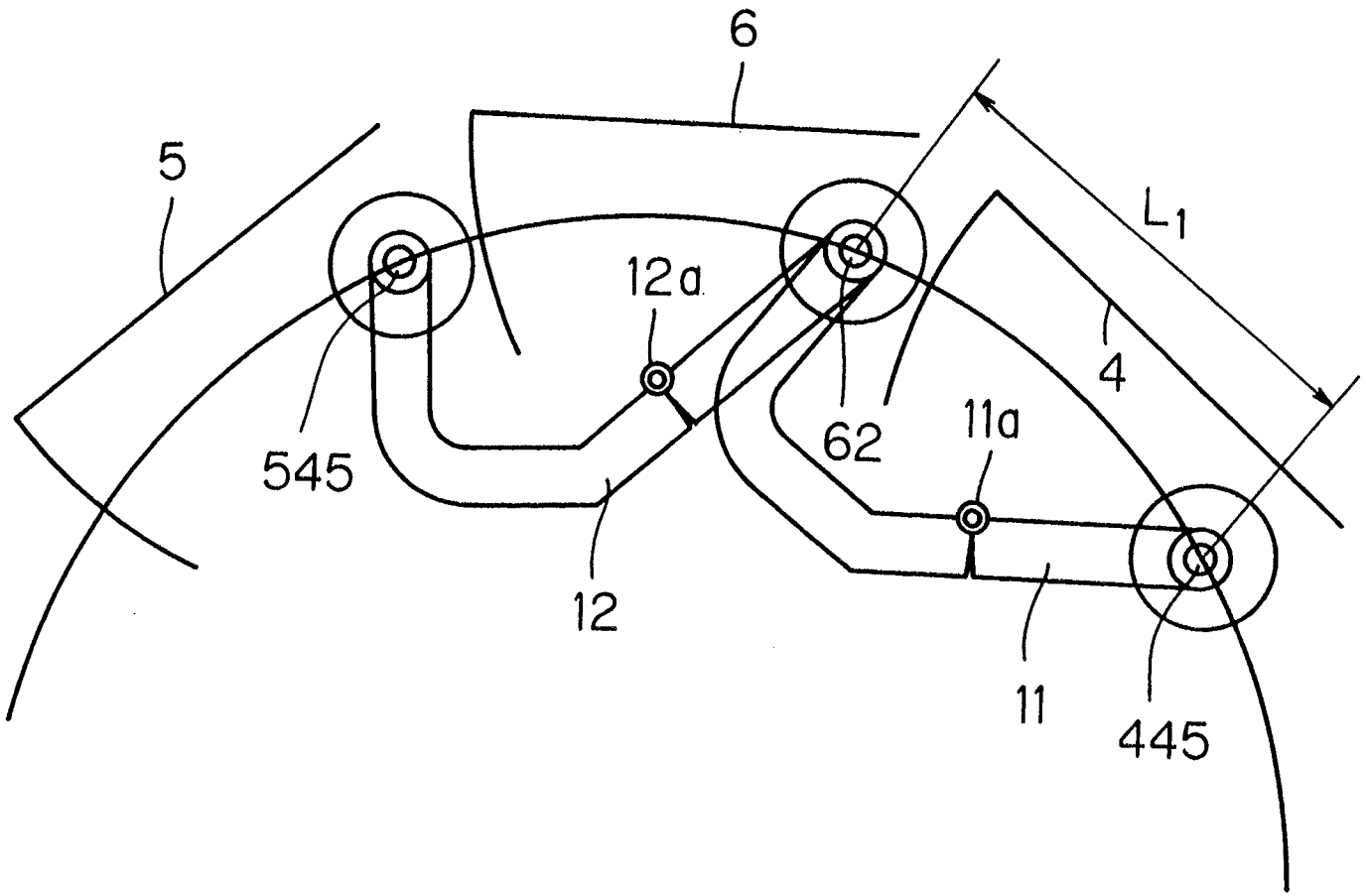
FIG. 11 is a side view showing the vehicle step 10 of FIG. 2 moving in a reversal point.

FIG. 9 is a side view showing the connected state of the vehicle step 10 comprising the special steps 4 and 5 and step 6, and FIG. 10 is a plan view thereof. In the figures, the parts having the same numerals as in FIGS. 1 through 8 are the same parts. The numeral 11 denotes a link which rotatably connects the shaft 445 in the movable step 400 to the axle shaft 62 in the step 6, and 12 denotes a link which rotatably connects the axle shaft 62 in the step 6 to the shaft 545 of the movable step 500 in the special step 5; a link having the same shape as that of the link 11 will serve as said link 12. To accommodate a decrease in the distance L1 between the shafts in the reversal points of the escalator, as shown in FIG. 11, each link 11, 12 is divided into two parts which are rotatably connected by a hinge 11*a*, 12*a* to allow the link to bend at the hinge to form a clearance between the parts.

The numeral 13 denotes a step chain which endlessly connects and drives the axle shaft 42 of the special step 4, the axle shaft 62 of the step 6, the axle shaft 52 of the special step 5, and the axle shafts of the ordinary steps 3. The numeral 14 denotes a front wheel guide rail (for the special steps 4 and 5, step 6 and ordinary steps 3); 15 denotes a rear wheel guide rail (for the specific steps 4 and 5, step 6 and ordinary steps 3); 16 denotes a guide rail for guiding the front wheels 443 of the movable step 400 in the special step 4 only during transport of a vehicle; and 17 denotes a guide rail for guiding the rear wheels 444 of the movable step 400 in the special step 4 only during transport of a vehicle.

Figure 12:
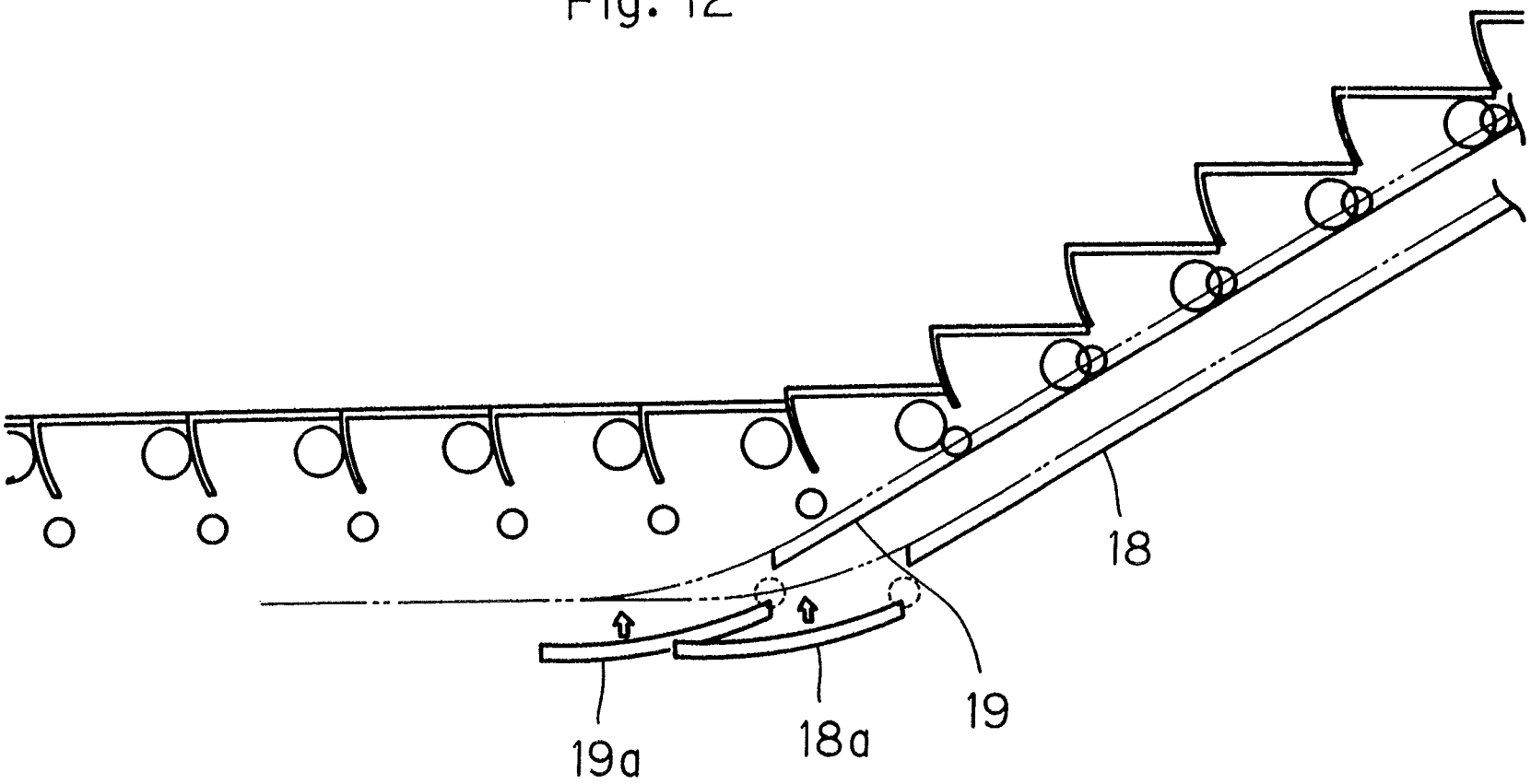
FIG. 12 is a view showing the disposition of point switching rails 18*a*, 19*a* and guide rails 18, 19.

The numeral 18 denotes a guide rail for guiding the front wheels 543 of the movable step 500 in the special step 5 only during transport of a vehicle; 19 denotes a guide rail for guiding the rear wheels 544 of the movable step 500 in the special step 5 only during transport of a vehicle; and 18*a* denotes a point switching rail for guiding the front wheels 543 of the special step 5 to the guide rail 18. The point switching rail 18*a* is adapted to be moved upwardly and downwardly by a driving device (not shown) disposed in the vicinity of the escalator entrance area as shown in FIG. 12. On the other hand, 19*a* denotes a point switching rail for guiding the rear wheels 544 of the special step 5 to the guide rail 19, said guide rail 19*a* being adapted to be moved upwardly and downwardly by a driving device (not shown) disposed in the vicinity of the escalator entrance area as shown in FIG. 12.

The operation of the apparatus of the present invention will now be described with reference to the drawings.

During normal operation, since the movable step 400 in the special step 4 remains locked as the latches 452 of the locking devices 450 shown in FIG. 4 are fitted in the latch supports 45 of the fixed step 40, the fixed step 40 and the movable step 400 move as a single step, not differing substantially in appearance from the ordinary steps 3. Further, in the special step 5, since the point switching rails 18*a* and 19*a* are in their lower positions, the front and rear wheels 543 and 544 do not contact the point switching rails 18*a* and 19*a* and hence they are not guided to the guide rails 18 and 19. Therefore, the fixed and movable steps 50 and 500 move as a single step, not differing substantially in appearance from the ordinary steps 3. Thus, the escalator operates as an ordinary one.

When a physically handicapped person in a wheelchair comes to the entrance area in a lower story shown in FIG. 1 and pushes the vehicle operating button PB1, the approach of the special step 4 to the entrance area in this lower story is detected by, for example, a known detection mechanism having a limit switch which detects a projecting element installed on the special step 4 alone, and the escalator is decelerated while lowering the unlocking tracks 454 to move the latches 452 to the unfixing step side through the rollers 451*a*, rods 451 and links 451*b*, thereby unlocking the movable step 400 in the special step 4 and raising the point switching rails 18*a* and 19*a*.

Thereupon, whereas the fixed step 40 of the special step 4 has its front and rear wheels 43 and 44 guided by the front and rear wheel guiding rails 14 and 15, respectively, as usual and thereby moves in the same path as the ordinary steps 3, the movable step 400 moves with its front and rear wheels 443 and 444 uniquely guided by the front and rear wheel guiding rails 16 and 17, respectively, with the result that the movable step 400 moves in a different path separate from that of the fixed step 40. That is, the movable step 400 descends relative to the fixed step 40, forming a level difference as shown in FIG. 13.

Figure 13:
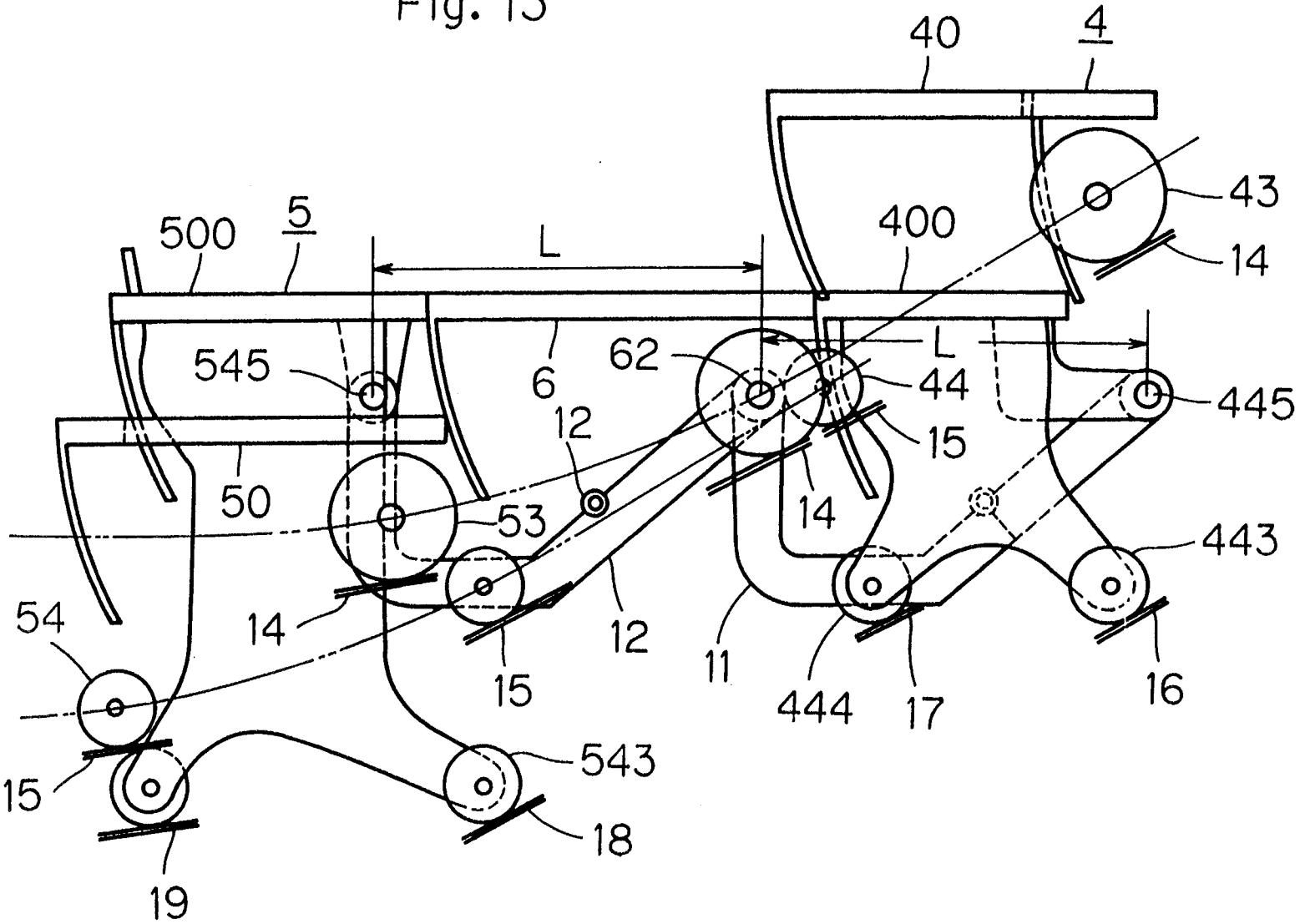
FIG. 13 is a side view showing the vehicle step 10 in a transition area in the escalator.

On the other hand, in the case of the special step 5, the fixed step 50 has its front and rear wheels 53 and 54 guided by the front and rear wheel guiding rails 14 and 15, respectively, as usual and thereby moves in the same path as the ordinary steps 3, while the movable step 500 moves with its front and rear wheels 543 and 544 uniquely guided by the point switching rails 18*a* and 19*a*, respectively, with the result being that the movable step 500 moves in a different path separate from that of the fixed step 50, ascending relative to the fixed step 50, forming a level difference as shown in FIG. 13.

In this connection, it is to be noted that the treads of the movable steps 400 and 500 of the special steps 4 and 5 and the tread of the step 6 can be kept flush with each other in any region in the lift of the escalator; therefore, a passenger using a vehicle can step on the vehicle step 10 safely even if the escalator is not stopped.

When the passenger stepping on the vehicle step 10 pushes the stepping-on confirmation button PB2, the wheel stops 546 installed in the movable step 500 of the special step 5 are projected to provide safety while gradually accelerating the escalator.

Figure 14:
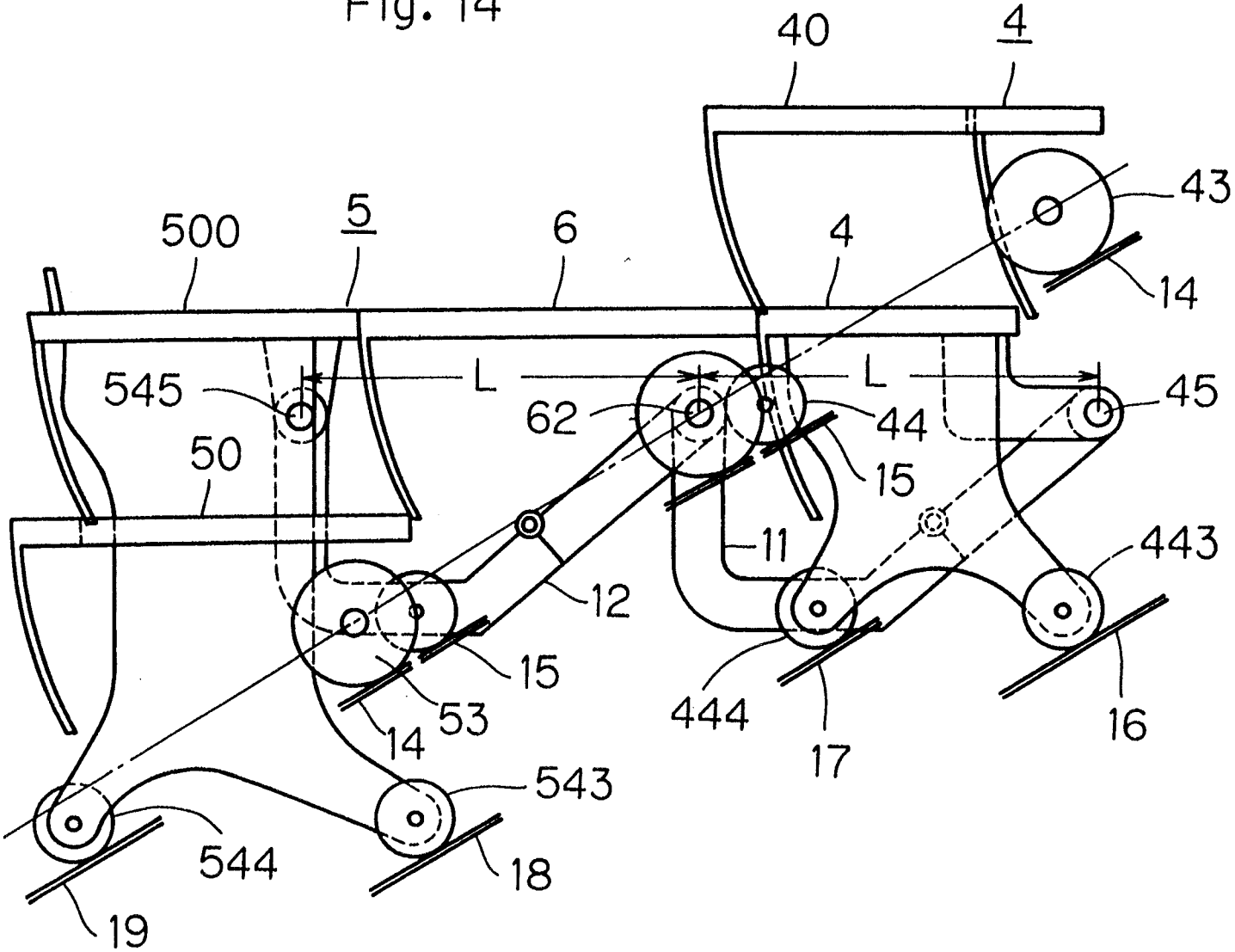
FIG. 14 is side view showing the vehicle step 10 in the inclined region of the escalator.

Thereafter, the movable step 400 of the special step 4, as shown in FIGS. 13 and 14, has its front and rear wheels 443 and 444 guided by the guide rails 16 and 17, respectively, while the movable step 500 of the special step 5 has its front and rear wheels 543 and 544 led by the point switching rails 18*a* and 19*a* and guided by the guide rails 18 and 19, respectively, and since the shafts of these steps are connected to the links 11 and 12, the steps are moved with the distance L between the axle shaft 62 of the step 6 and the shaft 445 of the special step 4 and between said axle shaft and the shaft 545 of the special step 5 remaining unchanged; therefore, the movable steps 400 and 500 and the step 6 are maintained horizontal as shown in FIGS. 2, 9, 13 and 14 to safely carry a vehicle such as a wheelchair thereon.

When the vehicle step 10 approaches the exit area in the upper story, the point switching rails 18*a* and 19*a* located in the upper story are raised while the escalator is decelerated. When the movable step 400 is raised relative to the fixed step 40 until it reaches a position where the latches 452 of the movable step 400 are opposed to the latch supports 45 of the fixed step 40, the latches 452 are automatically fitted in the latch supports 45 by the forces of the springs 453, establishing the locked state. And the passengers including the person in the wheelchair can now step off the escalator.

After the person in the wheelchair has stepped off the escalator, the stepping-off confirmation button PB3 is pushed, whereupon the wheel stops 546 of the special step 5 are retracted while the point switching rails 18*a* and 19*a* in the upper and lower stories are lowered and the unlocking tracks 454 are raised to restore their original state. Further, the escalator is gradually accelerated to its rated speed.

The above description refers to the lifting operation of the escalator, and the lowering operation can be likewise effected, a detailed description of which is therefore omitted. During stepping-on and stepping-off of a vehicle, the operation of the wheel stopping device is particularly important from the standpoint of safety. That is, during stepping-on, if the wheel stops fail to be projected, the vehicle is liable to fall by inertia, or if the wheel stops fail to be retracted, the vehicle cannot step off.

Therefore, the present applicant provides a vehicle stopping device, or a device having mechanism such that even if the escalator is moving, the projecting or retracting action automatically and smoothly takes place or when there is no wheelchair passenger utilizing the escalator, the wheel stops are retracted so as not to project above the tread of the step.

Figure 15:
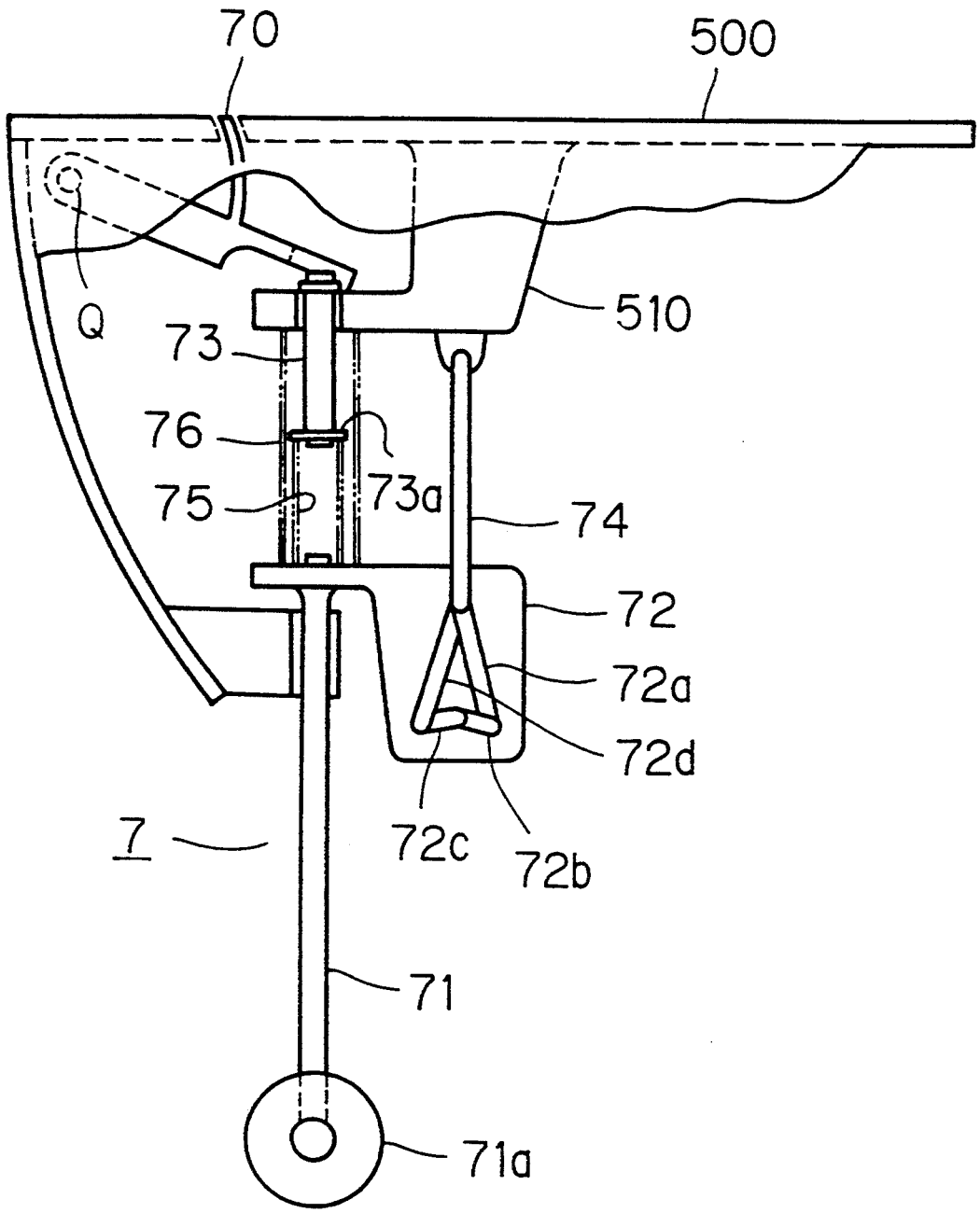
FIG. 15 is an enlarged view showing the entire mechanism of a wheel stopping device 7.

FIG. 15 is an enlarged view showing the entire mechanism of a wheel stopping device 7 attached to the movable step 500 of the special step 5. In the figure, the numeral 70 denotes a wheel stop installed in the movable step 5 to be rotatable around a point Q, and 71 denotes a rod having a roller 71*a* at the lower end and a plate 72 at the upper end, said rod being vertically movable. And the plate 72 has grooves 72*a*, 72*b*, 72*c* and 72*d* cut therein in loop form as shown in FIG. 15, said grooves having depths to be later described.

Figure 16:
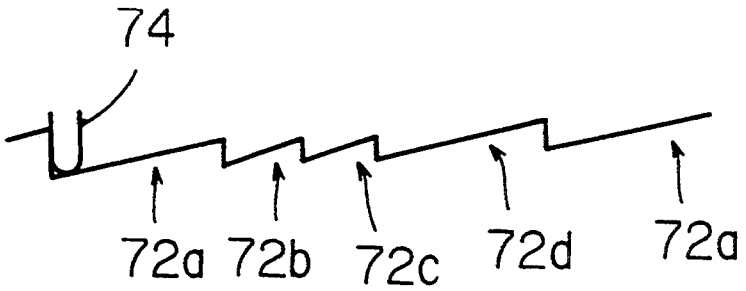
FIG. 16 is an explanatory view showing the depths of grooves 72*a*, 72*b*, 72*c*, 72*d* in a plate 72 shown in FIG. 15.

The numeral 73 denotes a rod vertically movably installed in a bearing 510 on the movable step 500, said rod being contacted at its upper end with part of the wheel stop 70 to support the weight of the latter and having a spring washer 73*a* attached to its lower end. The numeral 74 denotes a lever rotatably supported at its upper end in a bracket 510 on the movable step 500 and loop-wise guided at its lower end successively by the grooves 72*a*, 72*b*, 72*c* and 72*d* of the plate 72 in the order mentioned. That is, the grooves 72*a*, 72*b*, 72*c* and 72*d* of the plate 72 are formed such as that shown in FIG. 16 the first being the deepest and gradually shallowed, extending to the deepest region of the next groove. The lower end of the lever 74 turns clockwise without fail, never backward.

The numeral 75 denotes a spring installed between the plate 72 and the spring washer 73*a*, and 76 denotes a spring installed between the plate 72 and the bracket 510'.

The operation of the present wheel stopping device 7 will now be described in detail by taking the lifting operation as an example.

Figure 17:
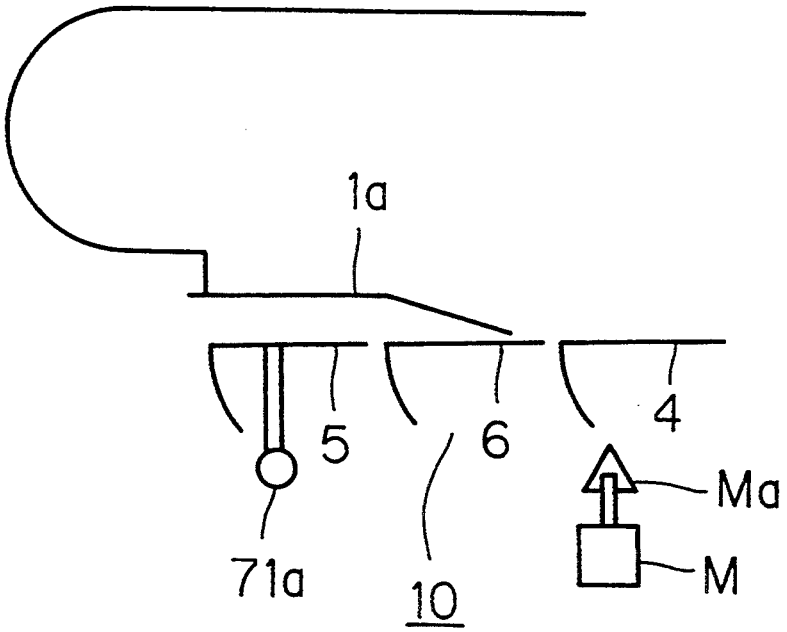
FIG. 17 is an explanatory view for explaining the operation of the wheel stopping device 7 in FIG. 15.

During the lifting operation, when a wheelchair passenger pushes the vehicle operating button PB1 (instead a portable transmitter may be used), the motor M installed on the escalator body 1 shown in FIG. 17 is driven to move a cam Ma upward.

On the other hand, when the vehicle step 10 approaches a floor plate 1*a* in the entrance area as a result of the vehicle operating button PB1 being manipulated, the escalator is decelerated. As the vehicle step 10 passes under the floor plate 1*a*, the roller 71*a* installed on the movable step 500 contacts the cam Ma and pushes it up.

Thereupon, the rod 71 together with the plate 71 is pushed up against the force of the spring 76, so that the lower end of the lever 74 is lowered along the groove 72*a* (actually, the plate 72 is lifted), moving to the groove 72*b*. And when the roller 71*a* is separated from the cam Ma as the movable step 500 continues moving, the rod 71 is somewhat moved backward by the force of the spring 76, but the lower end of the lever 74 is guided by the groove 72*b* to enter the groove 72*c* where it is locked. Therefore, even if the vehicle step 10 continues its travel, there occurs no change in the positions of the rod 71 and plate 72 relative to the movable step 500.

Figure 18:
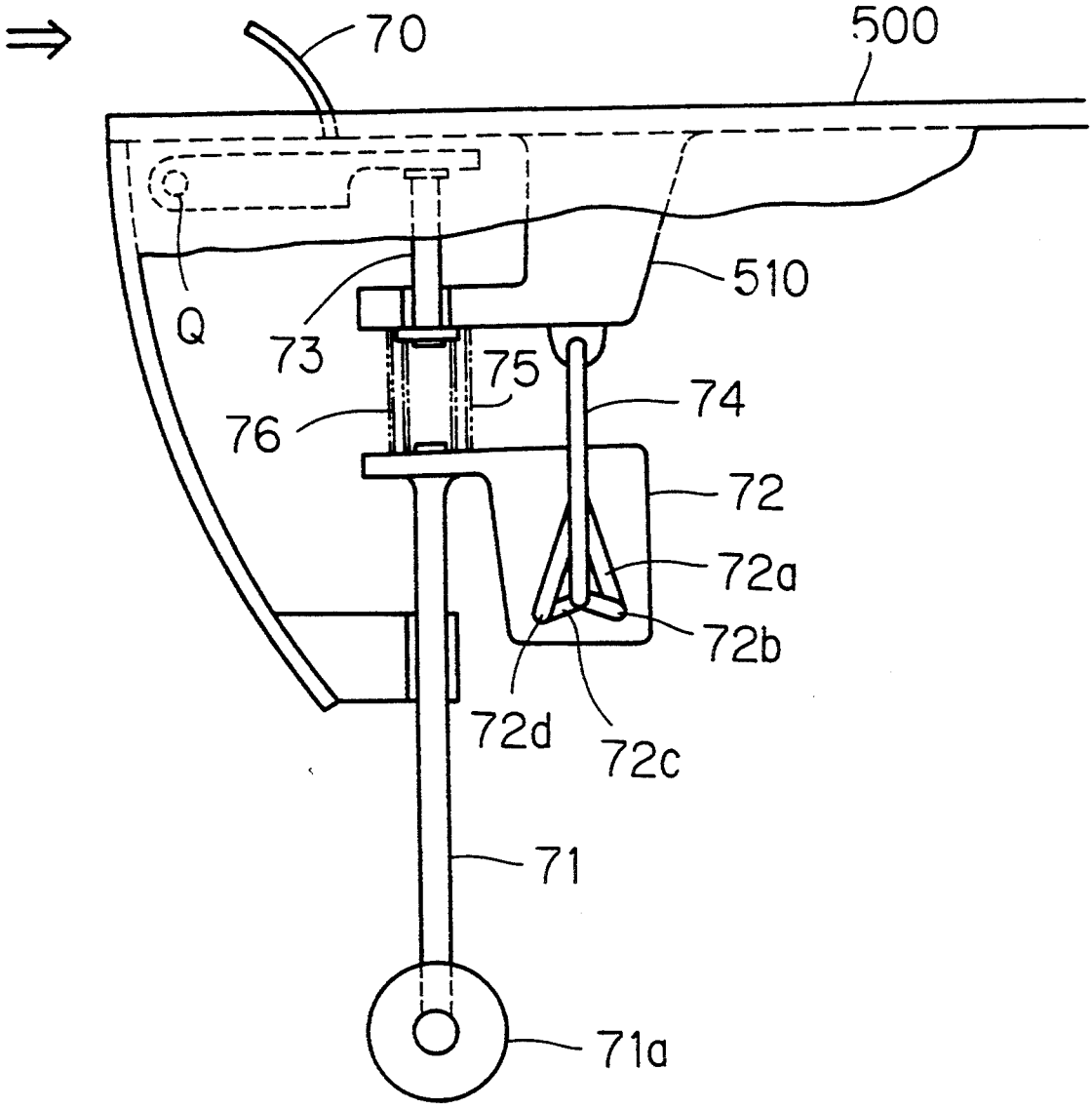
FIG. 18 is an enlarged view showing a wheel stop 70 of FIG. 15 in its projecting state.

As for the wheel stop 70, when the rod 71 and plate 72 are pushed up, the rod 73 is also pushed up by the force of the spring 75, so that the upper end of the rod 73 pushes up the wheel stop 70, with the result being that it projects above the tread surface of the movable step 500, as shown in FIG. 18.

With the wheel stop 70 thus projecting, the wheelchair passenger steps on the movable step 500 in the direction of arrow. When a force is applied to the wheel stop 70 in the direction of arrow, the spring 75 is compressed to allow the wheel stop 70 to retract below the tread surface without any trouble, and once the wheelchair steps on, it projects again to serve to prevent the wheelchair from falling (even if a reverse force is applied to the wheel stop 70, the latter will not move).

Figure 19:
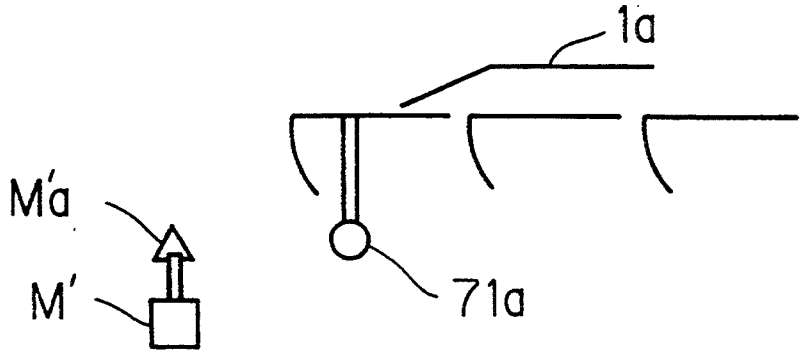
FIG. 19 is an explanatory view for explaining the restoring operation of the wheel stopping device 7 in FIG. 15.

When the vehicle step 10 approaches the exit area, the roller 71*a* comes in contact with the cam M'a already moved upward by the motor M' shown in FIG. 19 (the time to actuate the motor M' may be set at the time the vehicle operating button PB1 or the stepping-on confirmation button PB2 is manipulated) so that the roller 71*a* is pushed up. This time also, the rod 71 is pushed up along with the plate 72 against the force of the spring 76, whereby the lower end of the lever 74 lowers along the groove 72*c* (actually, the plate 72 is lifted), moving to the groove 72*d*. And when the roller 71*a* is separated from the cam M'a as the movable step 500 moves, the rod 71 is retracted downward by the force of the spring 76, and the lever 74 is moved with its lower end guided by the groove 72*d*, entering the groove 72*a* to restore its original state, where it is locked.

On the other hand, since the rod 71 and plate 72 are lowered, the wheel stop 70 also lowers together with the rod 73 under its weight, restoring the state of the ordinary step in which it is completely received in the tread of the movable step 500, as shown in FIG. 15.

In the lifting operation of the escalator, a passenger using a vehicle such as a wheelchair can step off the escalator at the exit area regardless of the state of the wheel stop 70; therefore, there is no need to take the trouble of decelerating the escalator at the exit area; however, in the lowering operation, deceleration is desirable from the standpoint of safety.

After the passenger has stepped off, he pushes the stepping-off confirmation button PB3 to rotate the motors M and M' in the opposite direction to pull down the cams Ma and M'a so as to prevent interference between the roller 71*a* and the cams Ma and M'a. Thus, during the lowering operation of the escalator there is no possibility of the wheel stop 70 projecting to form an obstacle which is liable to trip a passenger.

Another embodiment of the invention will now be described with reference to the drawings.

Figure 20:
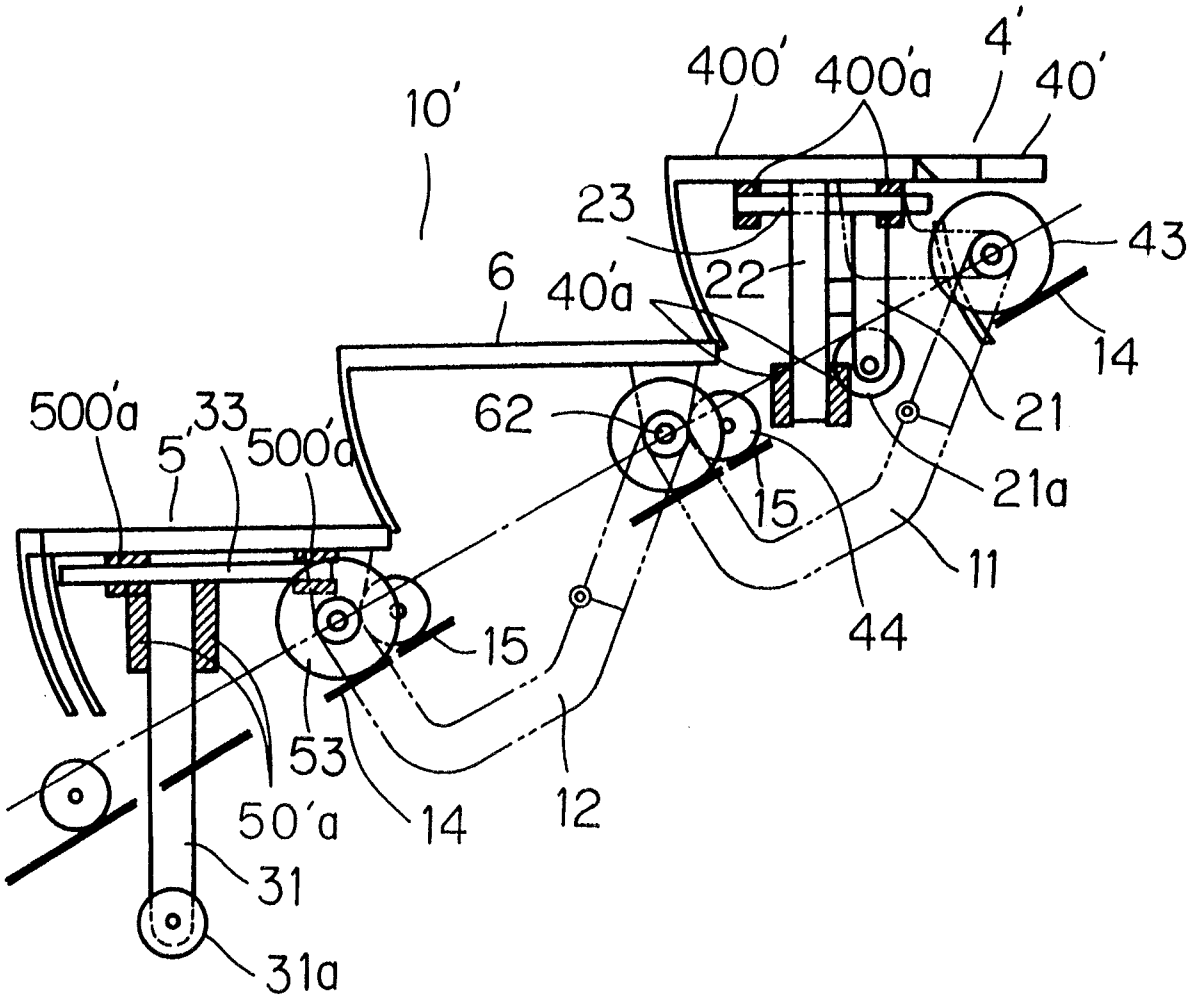
FIG. 20 is an enlarged side view of a vehicle step 10' according to another embodiment of the invention.
Figure 21:
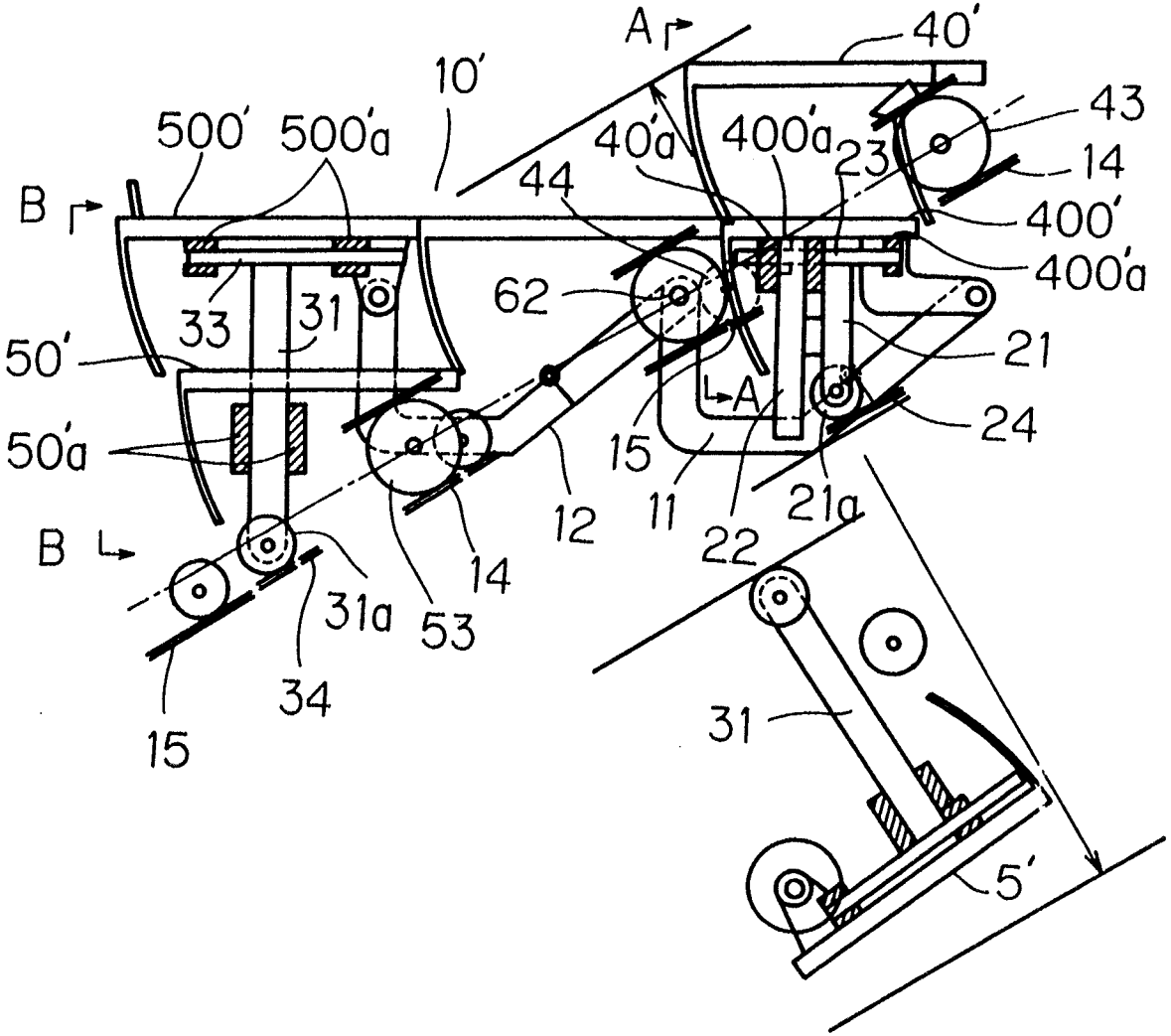
FIG. 21 is a side view showing the position of the vehicle step 10' in the inclined region of the escalator.
Figure 22:
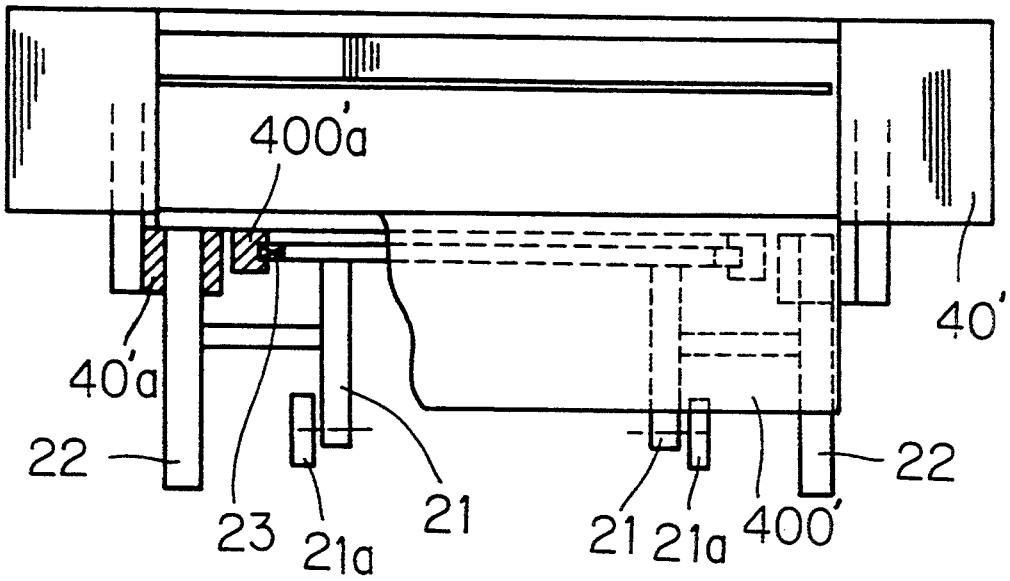
FIG. 22 is a view taken in the direction of arrow A—A in FIG. 21.
Figure 23:
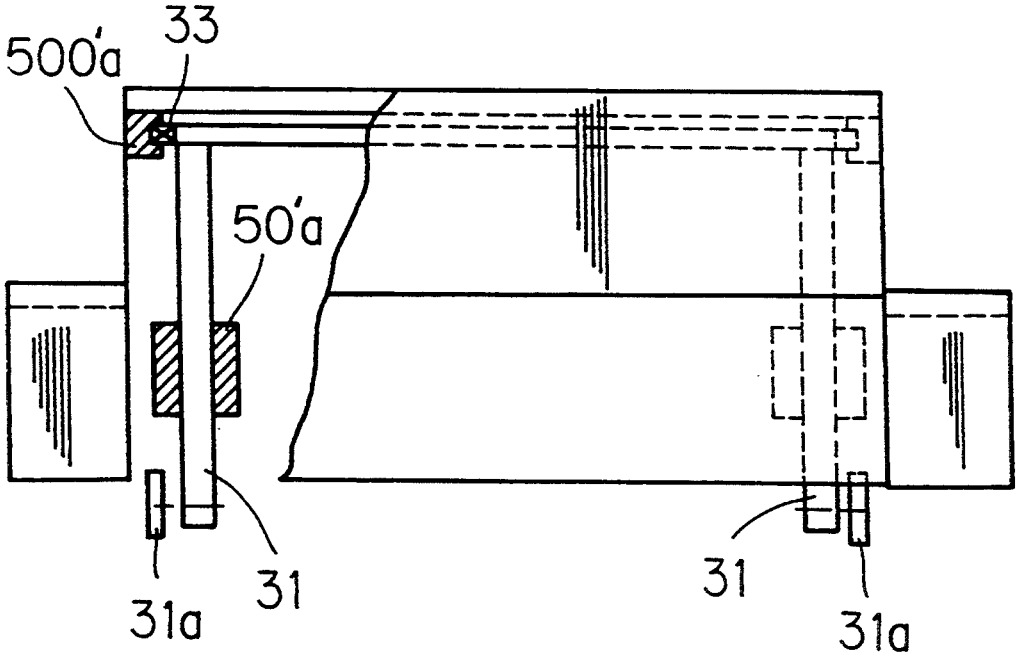
FIG. 23 is a view taken in the direction of arrow B—B in FIG. 21.

FIG. 20 is an enlarged side view of a vehicle step 10' according to another embodiment of the invention; FIG. 21 is a side view, corresponding to FIG. 14, showing the state of the vehicle step 10' in the inclined region of the escalator during transport of a wheelchair or the like; FIG. 22 is a view taken in the direction of arrow A—A in FIG. 21; FIG. 23 is a view taken in the direction of arrow B—B in FIG. 21. In the figures, the parts having the same numerals as those shown in FIGS. 4, 7 and 14 are the same.

The character 4' denotes a special step comprising a fixed step 40' and a movable step 400' (movable downwardly with respect to the fixed step 40'), said movable step 400' having first and second bars 21 and 22 connected together and extending downwardly. The first bar 21 has a wheel 21*a* rotatably attached to its lower end and is fixed at its upper end to a track stand 23, the latter being supported by a guide member 400'*a* (installed on the back surface of the tread of the movable step 400') so that it can be moved longitudinally of the escalator relative to the movable step 400'. On the other hand, the second bar 22 is guided by a guide member 40'*a* fixed to the fixed step 40' so that it can be vertically moved relative the fixed step 40'. The numeral 24 denotes a guide rail for guiding the wheel 21*a* in the movable step 400' of the special step 4' only during transport of vehicles or the like.

The character 5' denotes a special step comprising a fixed step 50' and a movable step 500' (movable upwardly with respect to the fixed step 50'), said movable step 500' having a downwardly extending bar 31. The bar 31 has a wheel 31*a* rotatably attached to its lower end and is fixed at its upper end to a track stand 33, the latter being supported by a guide member 500'*a* (installed on the back surface of the tread of the movable step 500') so that it can be moved longitudinally of the escalator relative to the movable step 500'. The bar 31 is guided by the guide member 50'*a* fixed to the fixed step 50' in such a manner that it can be vertically moved relative to the fixed step 50'. The numeral 34 denotes a guide rail for guiding the wheel 31*a* in the movable step 500' of the special step 5' only during transport of vehicles or the like.

The operation of this apparatus will now be described with reference to the drawings. The parts left undescribed are either the same as in the preceding embodiment or do not differ significantly therefrom.

During normal operation, the movable step 400' in the special step 4' has been locked as in the preceding embodiment and hence it is exactly the same as the ordinary steps 3. Since the point switching rail is positioned below the special step 5' is in its lower position, the wheel 31*a* of the movable step 500' does not contact the point switching rail and is not guided by the guide rail 34, so that the special step 5' is no different from the ordinary steps; thus, the escalator is operated and utilized as an ordinary one.

A physically handicapped person in a wheelchair comes to the entrance area and pushes the vehicle operating button PB1, whereby the movable step 400' of the special step 4' is unlocked and the point switching rail is lifted.

Thereupon, in the fixed step 40' of the special step 4', the front and rear wheels 43 and 44 are guided by the front and rear wheel guide rails 14 and 15, respectively, as usual to describe the same path as that for the ordinary steps 3. In the movable step 400', the wheel 21*a* is uniquely guided by the guide rail 24, with the result that it moves to describe a different path separate from that for the fixed step 40'. That is, since the bar 21 together with the bar 22 is controlled by the guide member 40'*a*, the bar 21 vertically lowers with respect to the fixed step 40' as the wheel 21*a* is guided by the guide rail 24, while the movable step 400' is controlled by the link 11 such that the distance L between the axle shaft 62 of the step 6 and the shaft 445 of the special step 4' does not change; therefore, a slip gradually develops between the track stand 33 and the guide member 500'*a*. The movable step 400' lowers while moving forwardly with respect to the fixed step 40', until it is flush with the step 6 as shown in FIG. 21.

On the other hand, in the case of the special step 5', the fixed step 50' is moved with its front wheels 53 guided by the front guide rails 14 and its rear wheels 54 guided by the rear wheel guide rails 15, describing the same path as that of the ordinary steps 3. As for the movable step 500', however, as a result of the wheel 31*a* being moved as it is uniquely guided by the guide rail 34 through the point switching rail, the movable step 500' describes a path different from that of the fixed step 50'.

That is, since the bar 31 is controlled by the guide member 50'*a*, it moves vertically upward relative to the fixed step 50' as the wheel 31*a* is guided by the guide rail 34. The movable step 500' is controlled by the link 12 such that the distance between the axle shaft 62 of the step 6 and the shaft 545 of the special step 5' remains unchanged; therefore, a slip gradually develops between the track stand 33 and the guide member 500'*a*. The movable step 500' moves upward along the riser surface of the step 6 while moving rearwardly with respect to the fixed step 50', until it is flush with the step 6, as shown in FIG. 21, thus establishing a state in which a vehicle such as a wheelchair can be safely transported.

Such simple construction has the following merits over the preceding embodiment.

(1) Since the required number of wheels is decreased, a lesser number of movable step guide rails are required;

(2) the truss depths of the inclined and reversal portions can be decreased.

Figure 24:
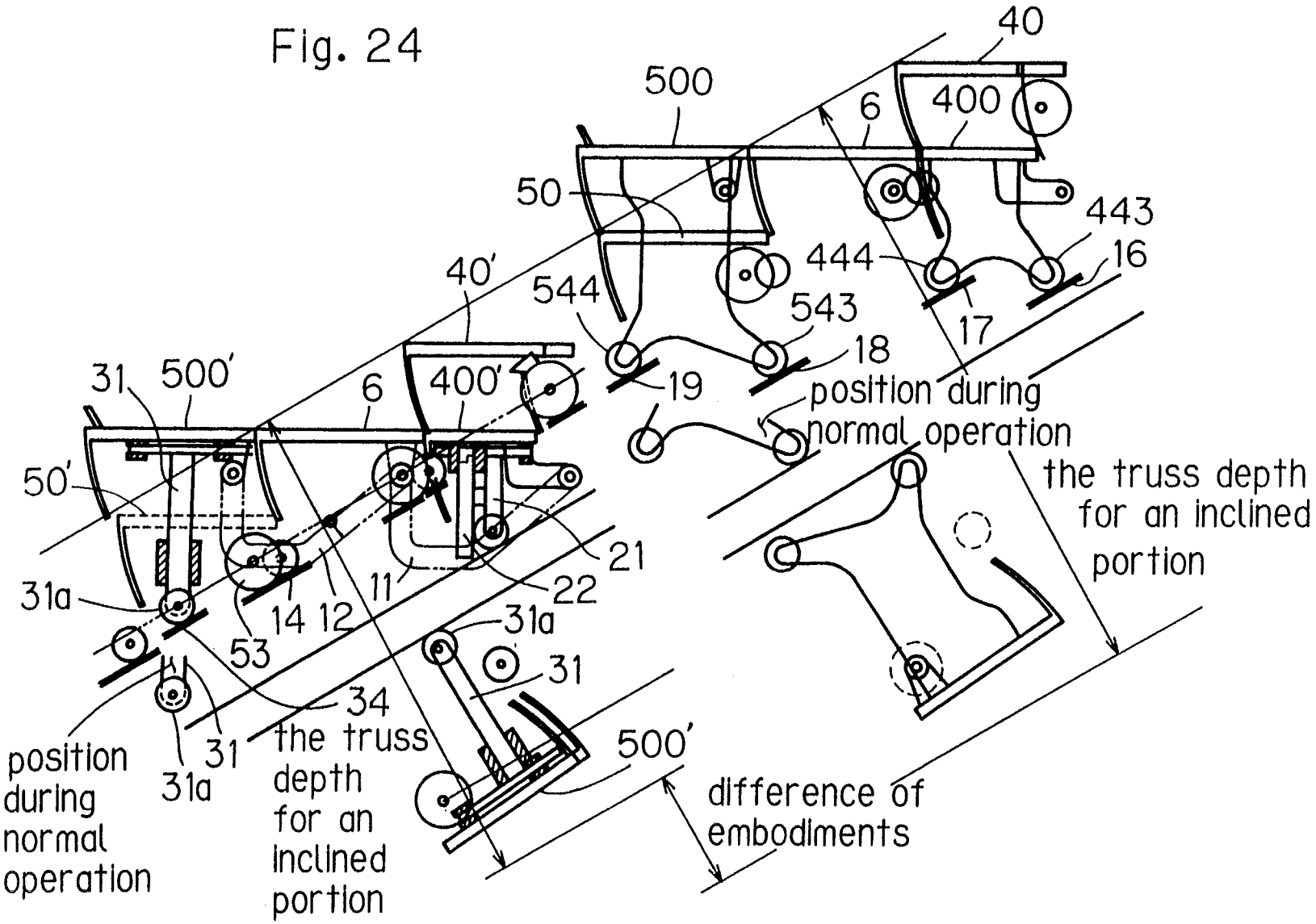
FIG. 24 is an explanatory view for explaining the effect of the vehicle step 10' shown in FIG. 20.
Figure 25:
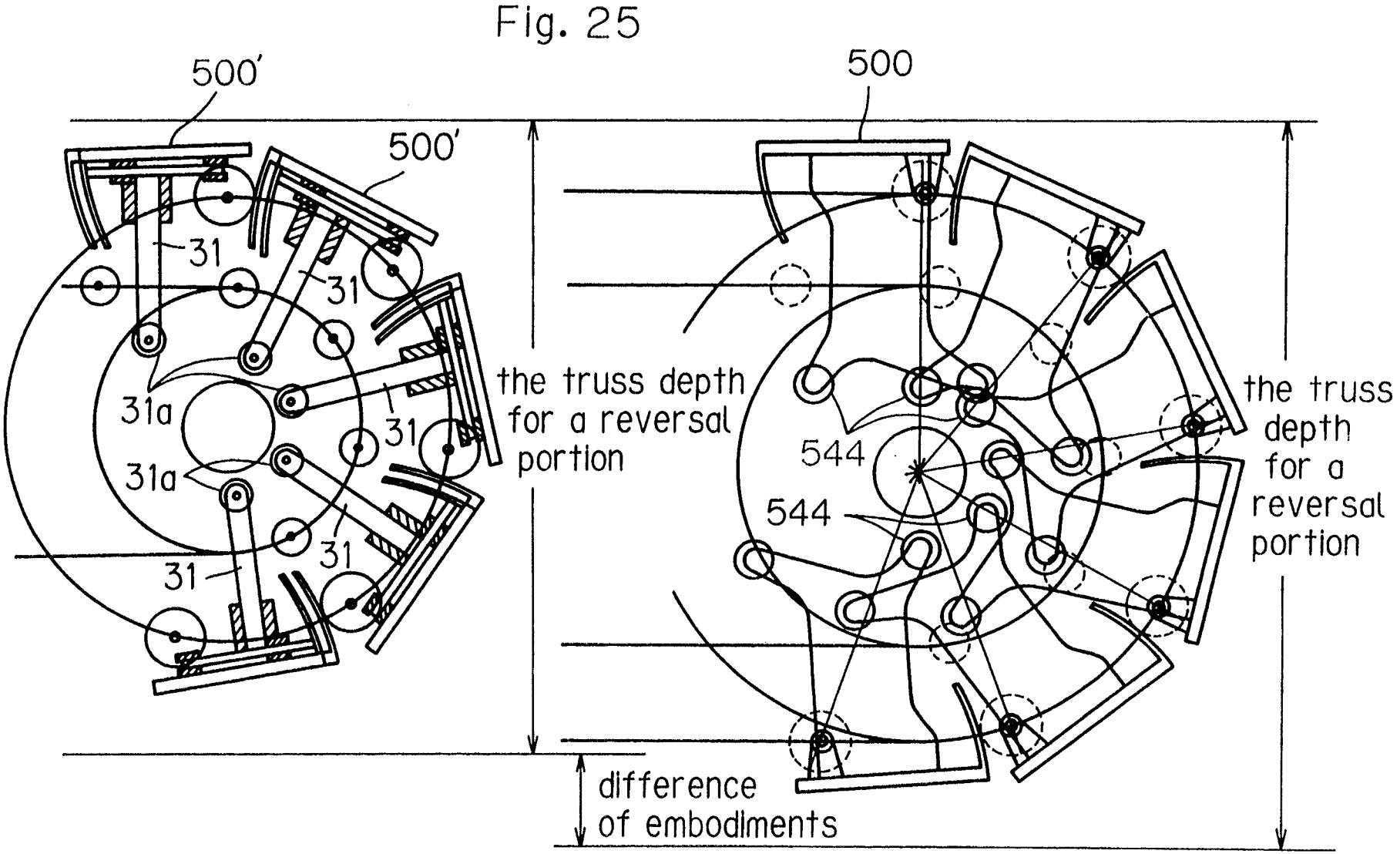
FIG. 25 is an explanatory view for explaining the effect of the vehicle step 10' shown in FIG. 20.

As to (2) above, in the case where there are front and rear wheels, the truss depth is necessarily great, as shown in FIGS. 24 and 25, but in the case of this embodiment the distance between the tread of the step and the wheel is reduced to the necessary minimum value, so that the truss depth (for both the inclined and reversal portions) can be decreased.

If the construction of the bar 31 is made to be one having a displacement enlarging mechanism as shown below, the downward step projection can be made small to decrease the truss depth.

Figure 26:
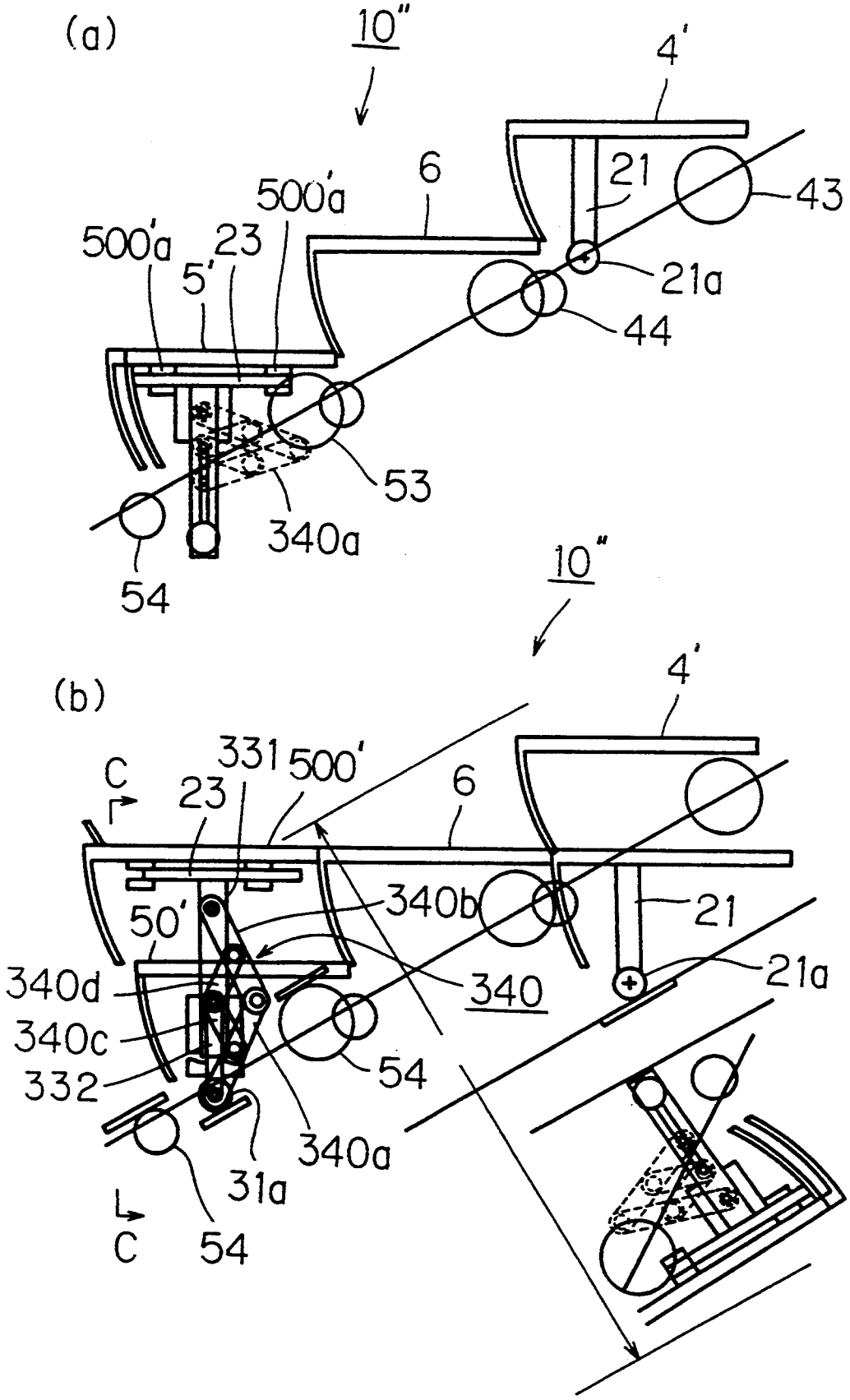
FIG. 26 is an enlarged side view of a vehicle step 10" according to another embodiment of the invention.
Figure 27:
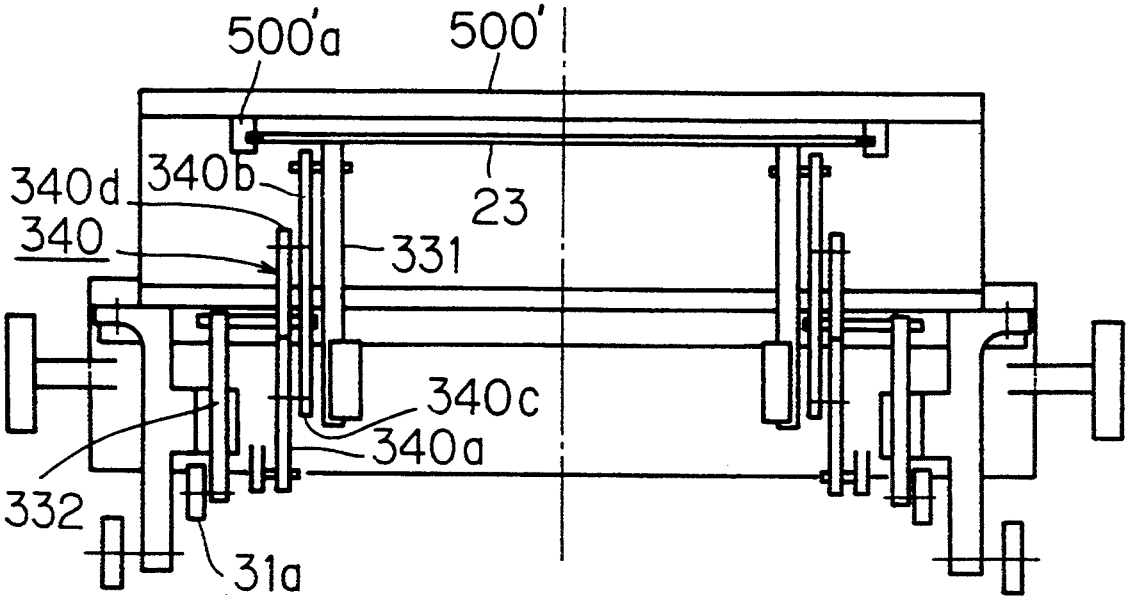
FIG. 27 is a view taken in the direction of arrow C—C in FIG. 26.

That is, as shown in FIGS. 26 and 27, the bar 31 is divided into a bar 331 having the track stand 23 fixed to the upper end thereof and a bar 332 having the wheel 31*a* at the lower end, said bars 331 and 322 being connected together by a link mechanism 340, whereby the upward and downward movements of the wheel 31*a* are enlarged and then transmitted to the movable step 500'.

The link mechanism 340 comprises longer links 340*a* and 340*b* and shorter links 340*c* and 340*d*, the lower end of the link 340*a* being rotatably supported by the fixed step 50' to serve as a fulcrum for the link mechanism 340 and having the lower end of the link 340*c* rotatably connected to its intermediate portion. The upper end of the link 340*c*, the upper end of the bar 332, and the lower end of the link 340*d* are rotatably connected, the connected point serving as a pivotal point for the link mechanism 340. The upper end of the link 340*a* and the lower end of the link 340*b* are rotatably connected, the intermediate point of the link 340*b* and the upper end of the link 340*d* are rotatably connected, and the upper end of the link 340*b* is rotatably connected to the bar 331, the connected point serving as a point of application.

Therefore, in this case, if the wheel 31*a* is lifted or lowered by an amount of n, the movable step 500' is moved by an amount of 2n, and the normal position of the wheel 31*a* is shifted toward the tread as compared with the case of using the bar 31 alone, so that the truss depth can be decreased by the corresponding amount.

Figure 28:
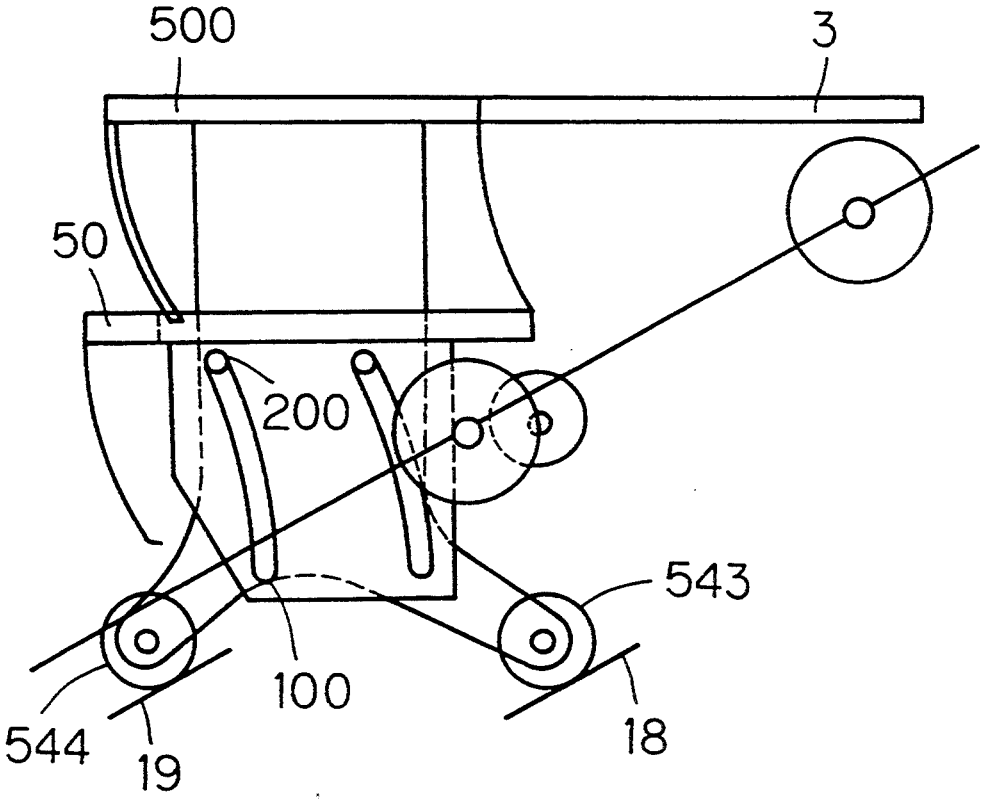
FIG. 28 is a side view showing another example of the connected state of the vehicle steps 10 and 10'.

The above description refers to the case where the movable steps 400, 500, 400', 500' are connected by the step 6 and links to prevent the clearance between the treads from widening or narrowing. However, another arrangement may be used wherein as shown in FIG. 28, either the movable step or the fixed step is formed with a notch 100 and the other is provided with a roller 200, so that the movable step is lifted or lowered in a controlled manner as said roller 200 is guided by said notch 100. Thus, the invention is not limited to the embodiment using links.

Figure 29:
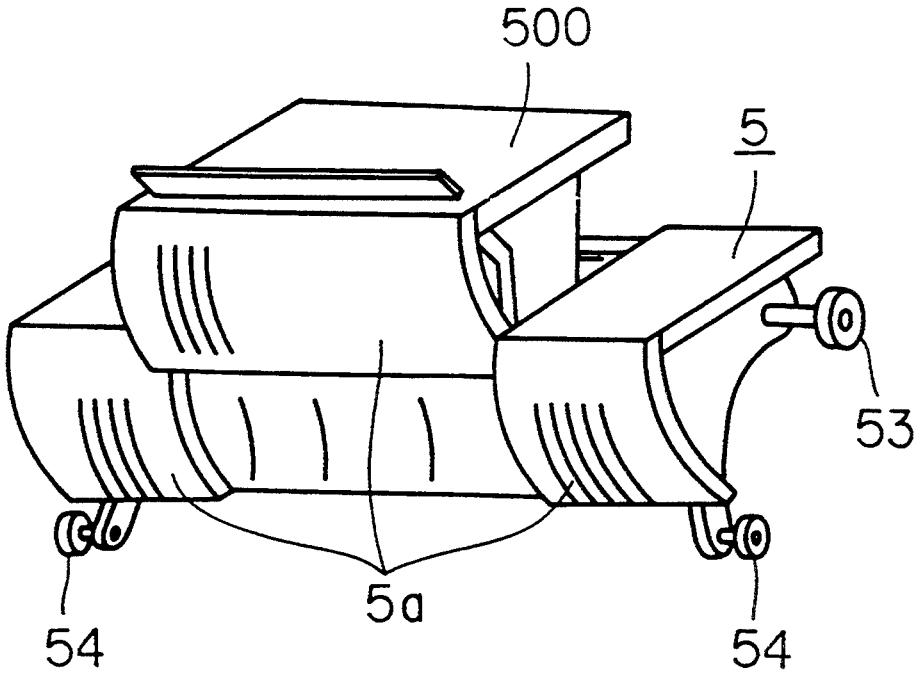
FIG. 29 is a complete perspective view showing another example of special steps 5 and 5'.
Figure 30:
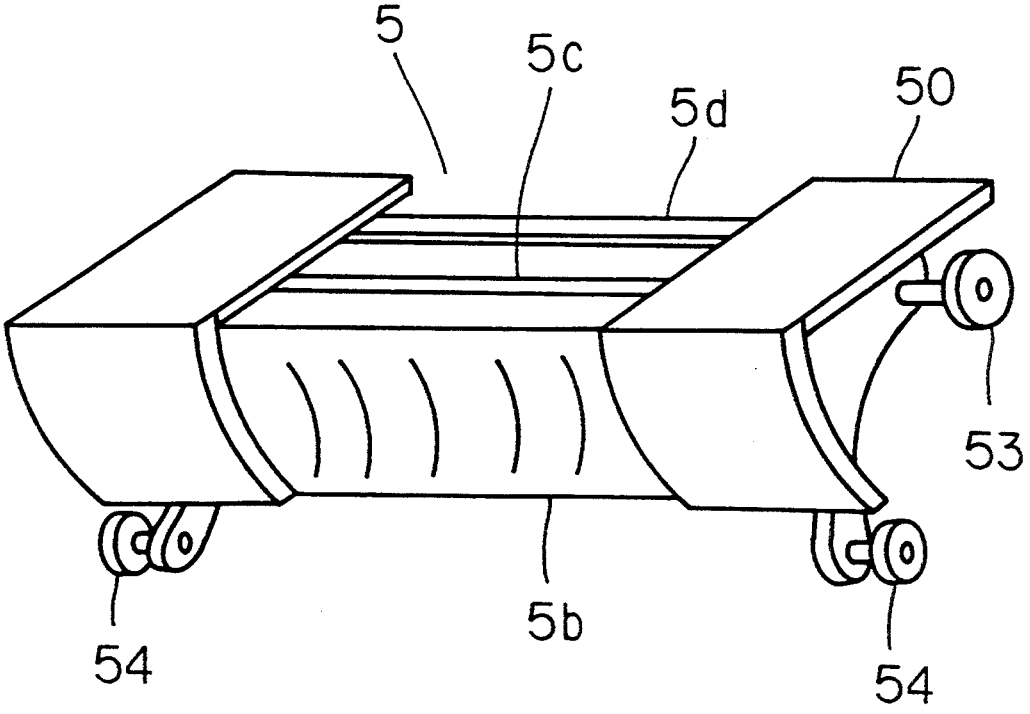
FIG. 30 is a complete perspective view showing another example of fixed steps 50 and 50'.
Figure 31:
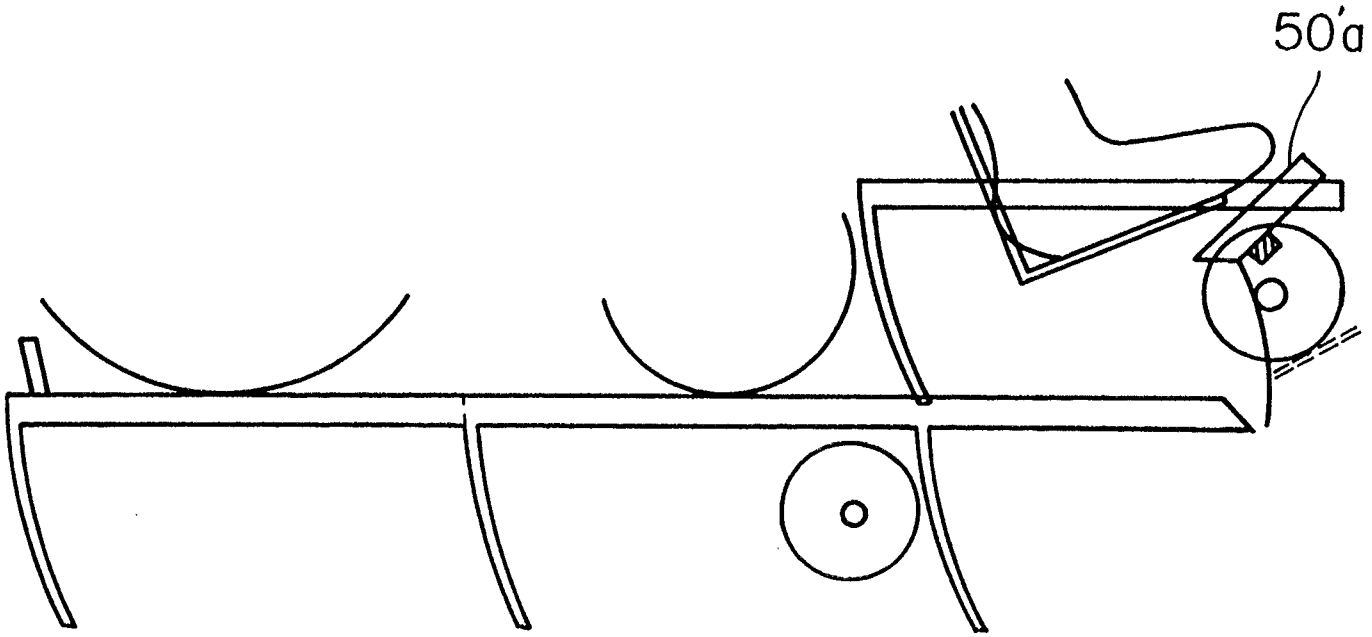
FIG. 31 is a side view showing another example of special steps 4 and 4'.

Further, the example has been given in which the special steps 4, 5, 4', 5' are provided with movable steps 400, 500, 400', 500' to form vehicle steps 10 and 10'. However, in the case of special step 5, 5' alone, it is possible to obtain an escalator apparatus which attains the intended object by employing an arrangement in which the tread alone is made movable. As for the arrangement of the movable step 500, 500', it may have a part or the whole of the riser 5*a* of the special step 5, as shown in FIG. 29, instead of the riser 500 shown in FIG. 6. That is, it may serve to form the riser portion. In this case, it is preferable that, as shown in FIG. 30, the fixed steps of the special step 5, 5' be connected right and left by a support frame 5*d*, an arcuate plate 5*b* and an axle shaft 5*c* so as to prevent shortage of rigidity. If the special step 5, 5' is constructed in the manner shown in FIG. 29, the space available for a wheelchair or the like vehicle is correspondingly increased. As for the special step 4, 4', as shown in FIG. 31, an inclined tread 50'*a* adapted to incline as the movable step 500, 500' lowers may be rotatably installed so as to increase the space to avoid interference with the footrest of a wheelchair.

Another embodiment which allows the truss depth to be decreased will now be described using the drawings.

Figure 32:
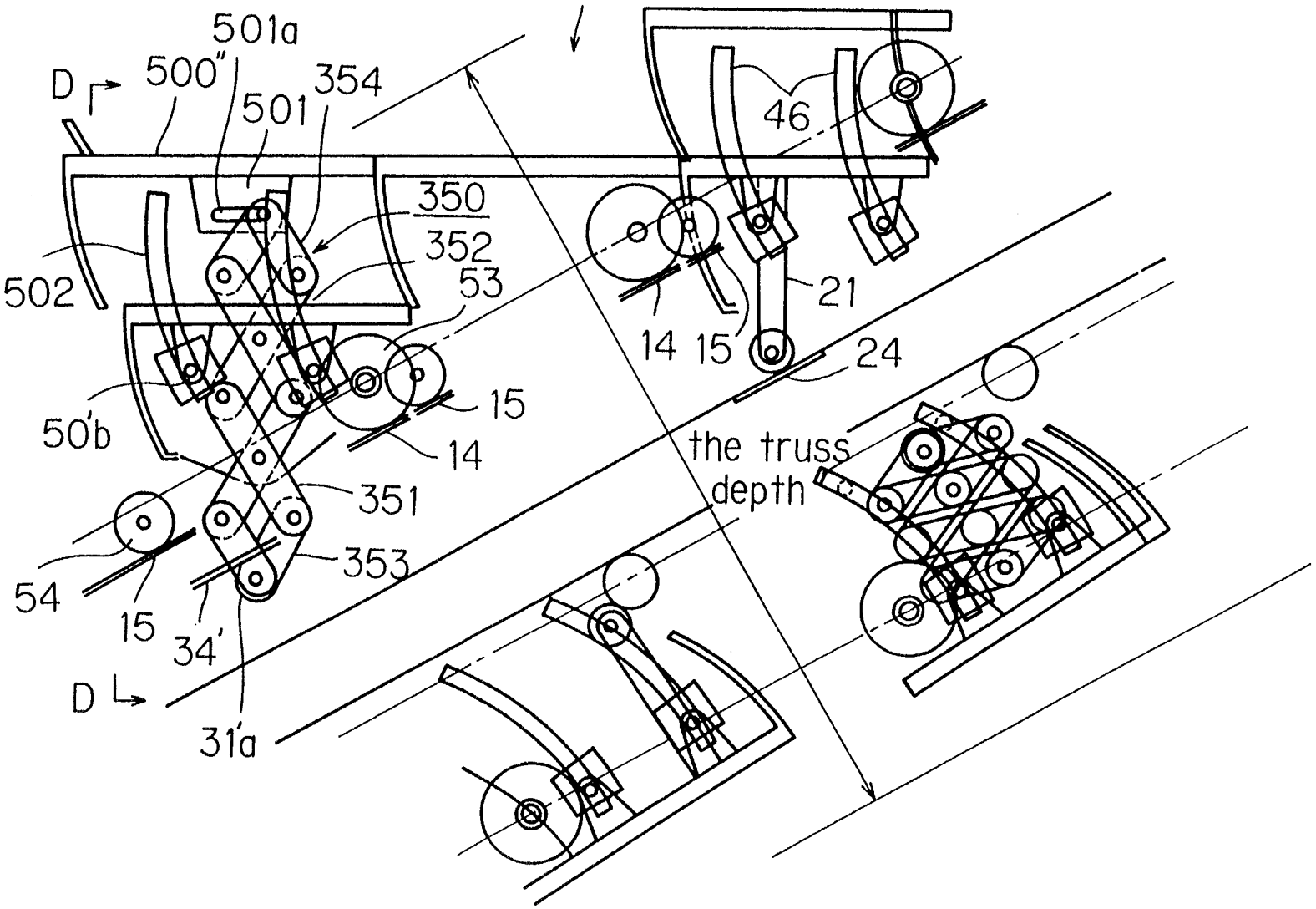
FIG. 32 is an enlarged side view of a vehicle step according to another embodiment of the invention.
Figure 33:
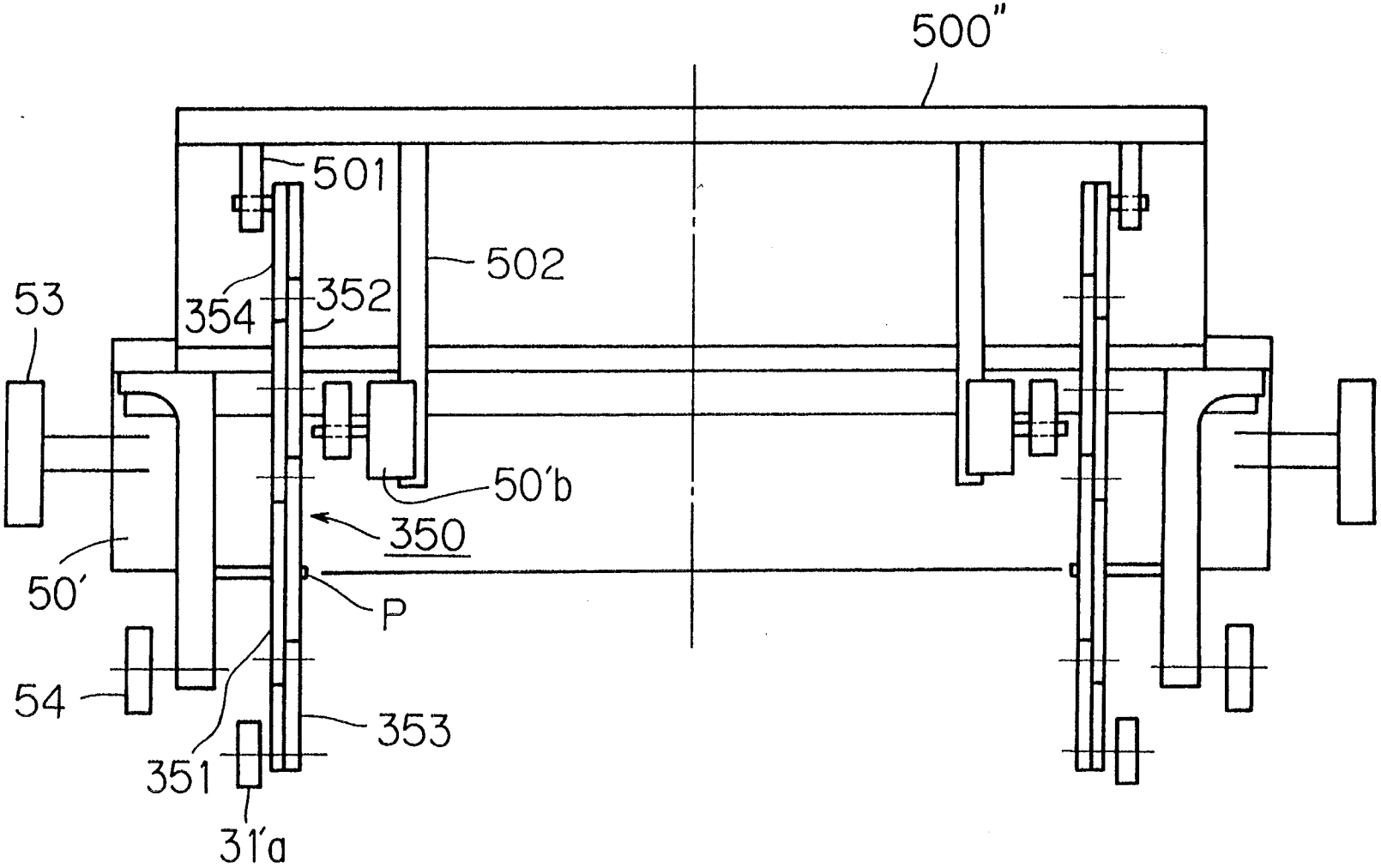
FIG. 33 is a view taken in the direction of arrow D—D in FIG. 32.

FIG. 32 is an enlarged side view of a vehicle step 10'' according to another embodiment of the invention, and FIG. 33 is a view taken in the direction of arrow D—D in FIG. 32. In the figures, the parts having the same reference characters as those in FIGS. 20, 21, 23 and 24 are the same parts. Particularly, the lifting mechanism for the upwardly movable step 500'' is improved.

The numeral 350 denotes an example of a lifting mechanism for lifting and lowering the movable step 500'', comprising two sets of link mechanism 351 and 352 of X form and two sets of link mechanisms 353 and 354 in V form, these mechanisms being rotatably connected together, the intermediate portion P of the link mechanism 351 being attached to the fixed step 50', the intermediate portion of the link mechanism 353 being provided with a wheel 31'*a*, the intermediate portion of the link mechanism 354 being slidably connected to an elongated opening 501*a* in a bracket 501 fixed to the back surface of the tread of the movable step 500'.

The numeral 502 denotes a guide member fixed to the lateral surface of the movable step 500'' and adapted to engage an engaging member 50'*b* installed on the fixed step 50' and supported by the engaging member 50'*b* to effect the positioning of the movable step 500''.

The two guide members 502, as shown in FIG. 32, are advantageous in maintaining the horizontal position of the movable step 500''. To accomplish the same result, however, only one guide member 502 may be utilized in conjunction with an arrangement employing a track stand 33 for horizontal and vertical guidance (by a guide member 50'*a* for the vertical direction, and by a guide member 500'*a* for the horizontal direction).

Figure 34:
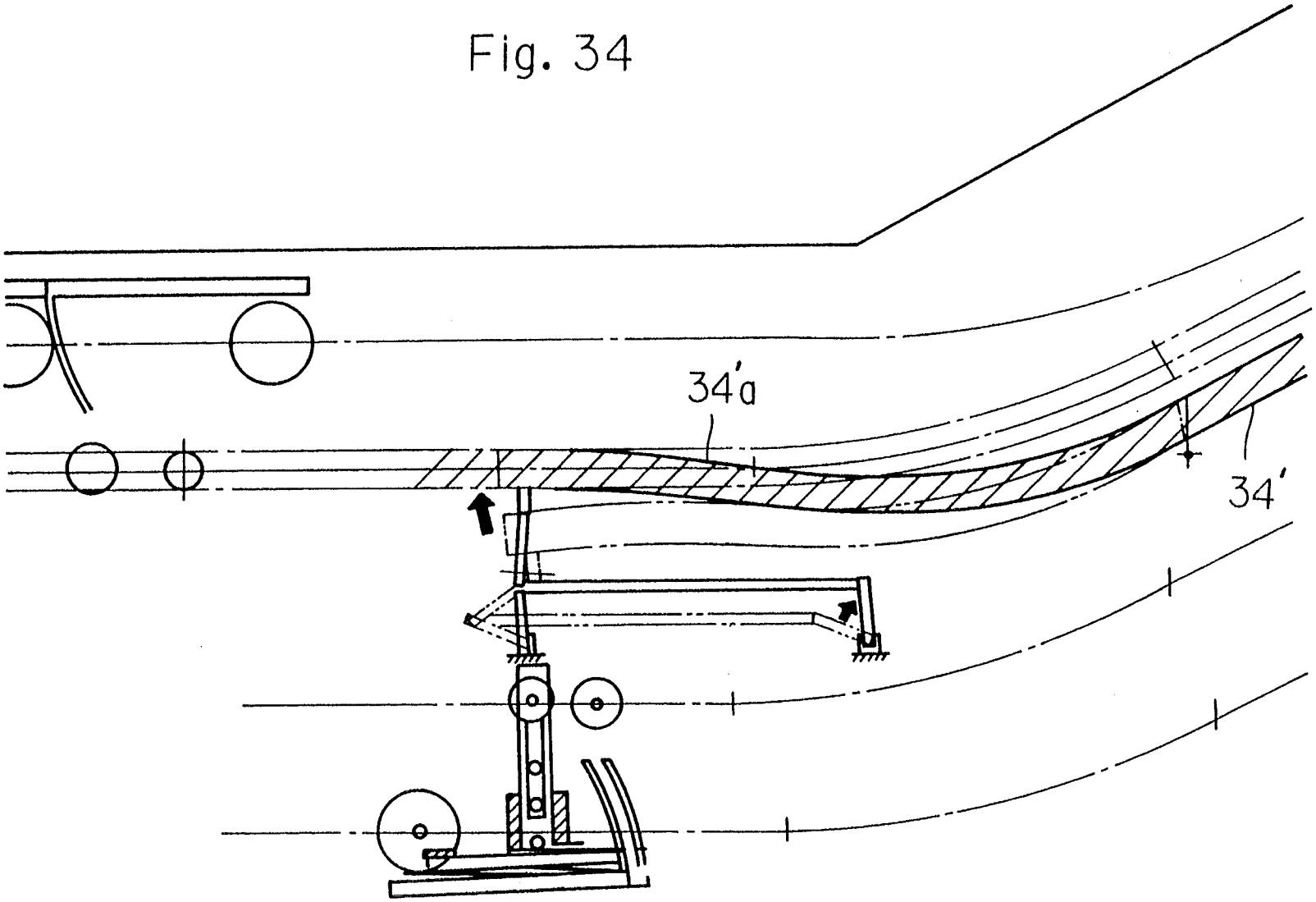
FIG. 34 is a view showing the disposition of a guide rail 34' in FIG. 32.

The character 34' denotes an inverted L-shaped guide rail installed on the truss for guiding the wheel 31'*a*. In the vicinity of the entrance area of the escalator, as shown in FIG. 34, it has a movable rail 34'*a* which is vertically movably connected to assume a lower position shown in dash-two-dot lines during normal operation and an upper position shown in solid lines during vehicle transport.

In addition, the numeral 46 denotes a guide member fixed to the lateral surface of the fixed step 40' in the special step 4', adapted to engage an engaging member 400'*b* to support the latter and effect the positioning of the movable step 400'.

Therefore, in the case of this embodiment, when the wheel 31'*a* is guided by the movable rail 34'*a* displaced upwardly, the wheel 31'*a* is gradually displaced downwardly to cause the link mechanisms 353 and 351 to extend vertically from the center defined by the intermediate point P (attached to the fixed step 50') of the link mechanism 351, with the result that the interconnected link mechanisms 352 and 354 upwardly expand to lift the movable step 500'' until the latter is flush with the step 6.

On the other hand, during the normal operation with the movable rail displaced downwardly, the wheel 31'*a* passes the upper position without any possibility of interfering with the movable rail 34'*a* and guide rail 34'; thus, the special step 5'' is operated for circulation in its normal step form without being transformed.

Figure 35:
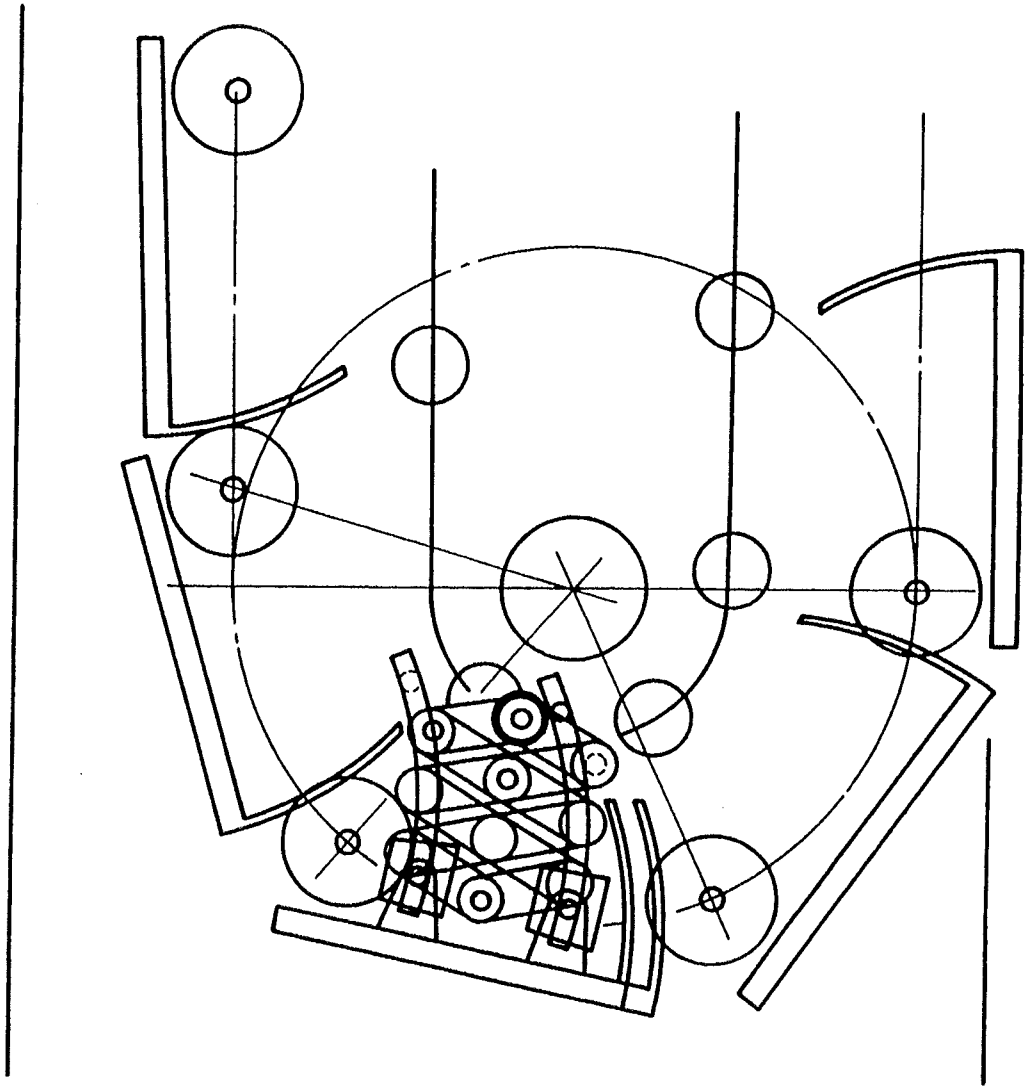
FIG. 35 is an explanatory view for explaining the effect of the vehicle step shown in FIG. 32.

Thus, such step using the mechanism for pressing the wheel 31'*a* downwardly and the movable step 500'' upwardly provides the following merits:

(1) Normally, the wheel 31'*a* can be completely received in its compressed state in the step, so that the truss depths of the incline and reversal portions can be greatly decreased, as shown in FIGS. 32 and 35.

(2) During vehicle transport, since a force pressing the wheel 31'*a* at all times is transmitted from the movable rail 34'*a* and guide rail 34', a downward force is applied at all times to the fixed step 50' through the link mechanisms 353 and 351. Therefore, there is no need to provide the guide rails 14 and 15 of the front and rear wheels 53 and 54 of the fixed step 50' with pressers to prevent them from floating. Stated concretely, the U-shaped rails can be dispensed with.

Figure 36:
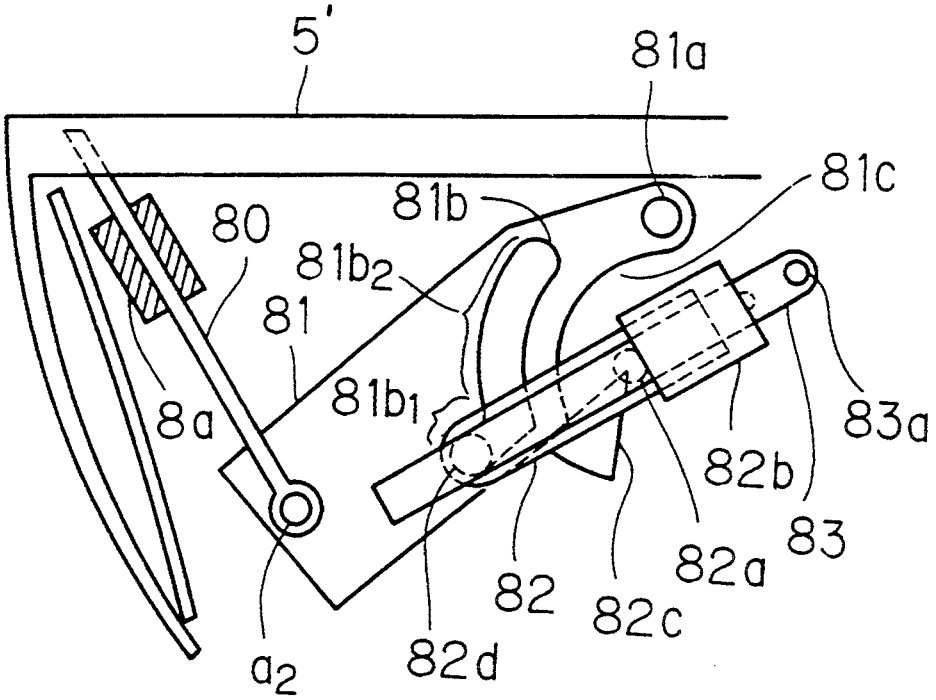
FIG. 36 is an enlarged view showing the entire mechanism of a wheel stopping device 8.
Figure 37:
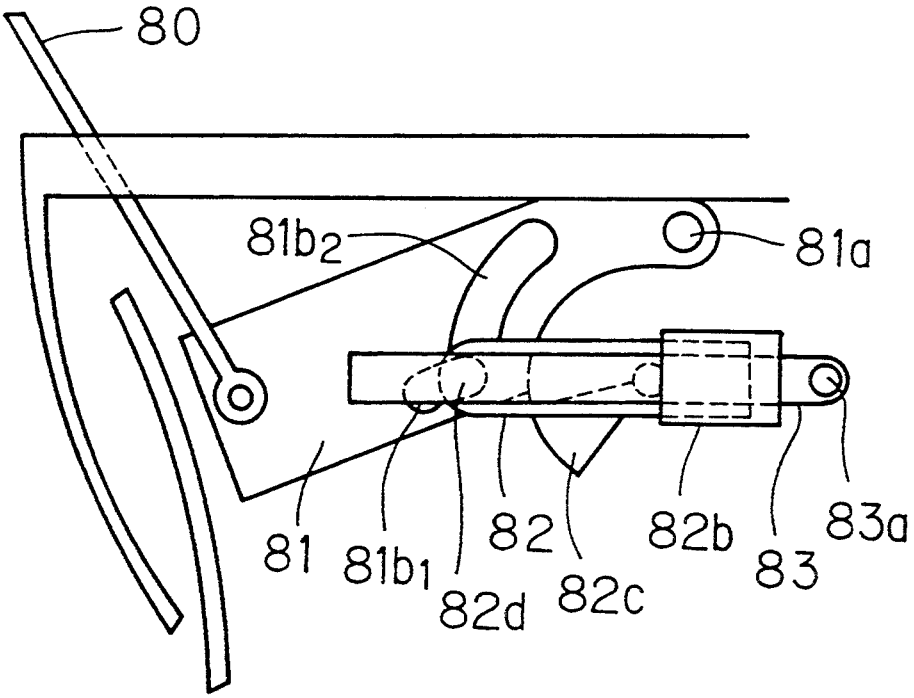
FIG. 37 is an explanatory view for explaining the operation of the wheel stopping device 8 in FIG. 36.
Figure 38:
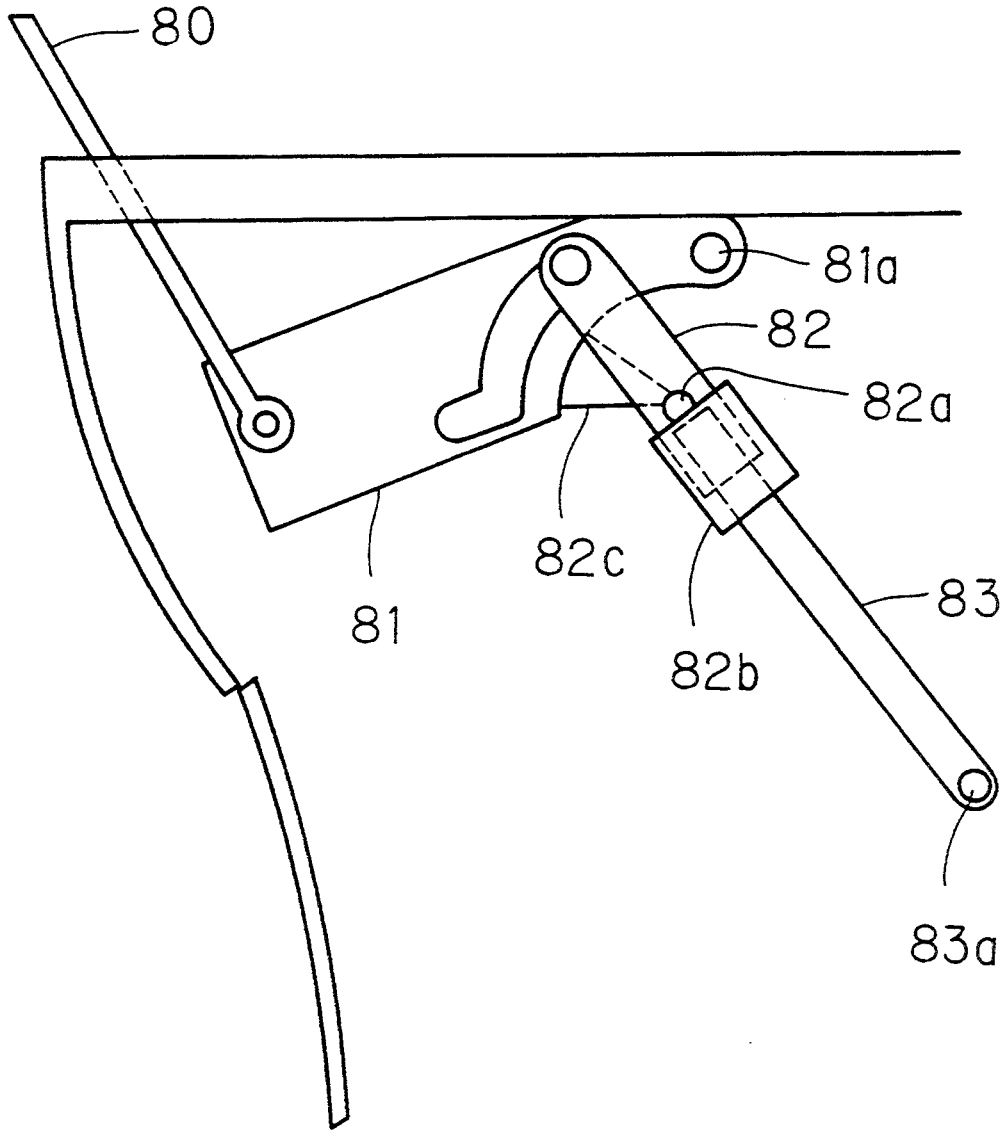
FIG. 38 is an explanatory view for explaining the operation of the wheel stopping device 8 in FIG. 36.

FIG. 36 is a side view showing another embodiment of a wheel stopping device provided on the special step 5, 5' or 5'', and FIGS. 37 and 38 are side views showing different phases of the operation of the wheel stopping device. In the figures, the numeral 80 denotes a wheel stop slidably guided by the special step 5' through a guide member 8a (fixed to the movable step 500'), and 81 denotes a plate rotatably installed on the movable step 500' by a pin 81a and having a curved notch 81b consisting of portions 81b$_1$ and 81b$_2$, and a recess 81c, with the wheel stop 80 rotatably connected to the front end thereof.

The numeral 82 denotes a plate rotatably installed on the movable step 500' by a pin 82a and having a cylindrical member 82b and a sectorial plate 82c fixed to one end thereof and a pin 82d attached to the other end, said pin 82d being guided by the notch 81b. The numeral 83 denotes a plate slidably extending through the cylindrical member 82b and rotatably attached at one end thereof to the fixed step 50' by a pin 83a. The wheel stopping device 8 is constructed in this manner.

The wheel stopping device 8 is characterized by a mechanism to allow the wheel stop 80 to project and retract according to the level difference between the fixed and movable steps 50' and 500', not requiring a special driving source.

The operation of the wheel stopping device 8 will now be described with reference to the drawings.

First, in the case where the movable step 500' is in the same horizontal plane as that of the fixed step 50', as shown in FIG. 36, the wheel stop 80 remains received in the special step 5'. However, when the vehicle operating button PB1 is manipulated, causing the wheel 31a in the movable step 500' to start to be guided by the guide rail 34 through the point switching rail, and as soon as a level difference develops between the movable and fixed steps 500' and 50', the plate 83 is rotated clockwise around the axis of the pin 83a. Thus, since the plate 82 is moved along with the plate 83, an upward force is applied to the plate 81 by the pin 82d through the notch 81b$_1$, thus rotating the plate 81 clockwise around the axis of the pin 81a.

Thereupon, the wheel stop 80 is pushed up a substantial distance by the plate 81 and is lifted as it is guided by the guide member 8a until it projects above the tread of the movable step 500', as shown in FIG. 37.

Thereafter, the movable step 500' is raised by the guide rail 34 through the wheel 31a and bar 31, with the level difference between it and the fixed step 50' increasing. As the plate 83 is further rotated clockwise, the plate 82 is moved, with the pin 82d simply moving in the notch 81b$_2$, so that no torque is transmitted to the plate 81, nor does the amount of projection of the wheel stop 80 increase. However, the sectional plate 82c enters the recess 81c of the plate 81 to prevent the latter from rotating counterclockwise; thus, even if a downward force should be applied to the wheel stop 80, there will not occur the inconvenience of the wheel stop 80 being lowered, the wheel stop performing its function.

As the level difference between the movable step 500' and the fixed step 50' gradually decreased with the special step 5' approaching the exit area, the plate 83 starts to rotate counterclockwise around the axis of the pin 83a and the plate 82 also moves with the plate 83. Thus, the pin 82d lowers in the notch 81b$_2$ while the sectional plate 82c comes out of the recess 81c. As the pin 82d approaches the notch 81b$_1$, it depresses the plate 81 through the notch 81b$_1$, thereby lowering the wheel stop 80, with the state changing successively to those shown in FIGS. 36 and 37 to return to the original one.

When the wheel stopping device 8 of such construction is used, because the mechanism ensures that it is not until a level difference develops between the movable step 500, 500' and the fixed step 50, 50' that the wheel stop 80 projects, the wheel stopping device remains inactive during normal operation; thus, sufficient safety is obtained.

In addition, the above description refers to the example in which the treads of the movable steps 400, 400', 500, 500' are lifted or lowered so that they become flush with the tread of the step 6. However, they may be lifted or lowered to the extent that some level difference remains; for example, the treads of the movable steps 400, 400', 500, 500' may be lifted or lowered to a level which is somewhat lower than that of the tread of the step 6, so as to prevent the vehicle from falling. Alternatively, the movable steps 400, 400', the step 6 and the movable steps 500, 500' may be successively increased in level in the order mentioned so as to draw the vehicle toward the front wheel side.

What is claimed is:

1. An escalator apparatus using a plurality of steps endlessly connected for movement, characterized in that;

at least two special steps included in the plurality of steps are disposed with a third step interposed therebetween, the first special step having a downwardly movable tread, the second special step having an upwardly movable tread, said movable treads being adapted to ascend or descend independently, to come to a position approximately in alignment with the height of the tread of the third step.

2. An escalator apparatus as set forth in claim 1, characterized in that;

said movable treads are adapted to ascend or descend in such a manner that they come to a position precisely in alignment with the height of the tread of the third step.

3. An escalator apparatus as set forth in claim 1, characterized in that;

the second special step has an interlocking mechanism for allowing an upwardly movable tread to ascend or descend according to the height of the tread of the third step.

4. An escalator apparatus as set forth in claim 1, characterized in that said third step is one of said plurality of steps.

5. An escalator apparatus as set forth in claim 1, characterized in that said movable treads have risers.

6. An escalator apparatus as set forth in claim 1, characterized in that said downwardly movable tread, said tread of said third step and said upwardly movable tread are connected together by links.

7. An escalator apparatus as set forth in claim 1, characterized in that the upwardly movable tread is provided with a projectable wheel stop.

8. An escalator apparatus as set forth in claim 1, characterized in that the first special step is provided with a locking device for locking the downwardly movable tread.

9. An escalator apparatus as set forth in claim 1, characterized in that the second special step is provided with a locking device for locking the upwardly movable tread.

10. An escalator apparatus using a plurality of steps endlessly connected for movement, characterized in that;

at least two special steps included in the plurality of steps are disposed with a third step interposed therebetween, the first special step having a downwardly movable tread, the second special step having an upwardly movable tread, said movable treads being adapted to ascend or descend according to the height of the tread of the third step;

said movable treads are provided with wheels; and rails are installed for guiding said wheels.

11. An escalator apparatus using a plurality of steps endlessly connected for movement, characterized in that;

at least two special steps included in the plurality of steps are disposed with a third step interposed therebetween, the first special step having a downwardly movable tread, the second special step having an upwardly movable tread, said movable treads being adapted to ascend or descend according to the height of the tread of the third step;

said movable treads are provided with front and rear wheels; and rails are installed for guiding said wheels.

12. An escalator apparatus using a plurality of steps endlessly connected for movement, characterized in that;

at least two special steps included in the plurality of steps are disposed with a third step interposed therebetween, the first special step having a downwardly movable tread, the second special step having an upwardly movable tread, said movable treads being adapted to ascend or descend according to the height of the tread of the third step;

said movable treads are provided with downwardly extending levers movable longitudinally of the escalator and having wheels at their lower ends; and rails are installed for guiding said wheels.

13. An escalator apparatus using a plurality of steps endlessly connected for movement, characterized in that;

at least two special steps included in a plurality of steps are disposed with a third step interposed therebetween, the first special step comprising a first fixed step and a first movable step movable downwardly relative to said first fixed step, the second special step comprising a second fixed step and a second movable step movable upwardly relative to said second fixed step, each of said first and second movable steps being provided with a wheel guided by a guide rail.

14. An escalator apparatus as set forth in claim 13, characterized in that the movable step in the second special step has a mechanism for upwardly moving said movable step when said wheel receives a downward force from the guide rail.

15. An escalator apparatus as set forth in claim 13, characterized in that said third step is one of said plurality of steps.

16. An escalator apparatus as set forth in claim 13, characterized in that the wheels include front and rear wheels and the rails include those for front and rear wheels.

17. An escalator apparatus as set forth in claim 13, characterized in that each movable step is provided with a downwardly extending lever movable longitudinally of the escalator, said lever having a wheel at its lower end.

18. An escalator apparatus as set forth in claim 13, characterized in that the downwardly movable step, the third step and the upwardly movable step are connected together by links.

19. An escalator apparatus as set forth in claim 13, characterized in that the fixed step is provided with a guide device for guiding the movable step.

20. An escalator apparatus as set forth in claim 13, characterized in that said second special step further has an amplifying mechanism for amplifying the upward movement of the tread of said second special step.

21. An escalator apparatus as set forth in claim 13 characterized in that said second special step further has an amplifying mechanism for amplifying the upward movement of the second movable step of said second special step.

22. An escalator apparatus, comprising:

a plurality of steps endlessly connected for movement;

first and second special steps included in the plurality of steps disposed with a third step interposed therebetween, the first special step including a downwardly movable tread, the second special step including an upwardly movable tread;

guide means for guiding said plurality of steps along desired paths of travel; and the guide means including means for selectively raising and lowering the upwardly and downwardly movable treads of the first and second special steps to respective positions approximately in alignment with the height of the tread of the third step.

23. An escalator apparatus as set forth in claim 22, the guide means further including:

guide rails, carried on a fixed portion of the escalator apparatus and defining a plurality of travel paths;

engaging means, carried on each of the upwardly and downwardly movable treads of the first and second special steps for movably following the guide rails to support said first and second special steps; and means for directing the engaging means to follow a selected one of the plurality of travel paths.

24. An escalator apparatus as set forth in claim 23, wherein the engaging means include wheels.

* * * * *